US009207613B2

(12) United States Patent
Hamaya et al.

(10) Patent No.: US 9,207,613 B2
(45) Date of Patent: Dec. 8, 2015

(54) IMAGE FORMING APPARATUS

(71) Applicants: Masahito Hamaya, Aichi (JP); Tetsuya Okano, Anjo (JP)

(72) Inventors: Masahito Hamaya, Aichi (JP); Tetsuya Okano, Anjo (JP)

(73) Assignee: BROTHER KOGYO KABUSHIKI KAISHA, Nagoya, Aichi (JP)

( * ) Notice: Subject to any disclaimer, the term of this patent is extended or adjusted under 35 U.S.C. 154(b) by 67 days.

(21) Appl. No.: 14/059,657

(22) Filed: Oct. 22, 2013

(65) Prior Publication Data

US 2014/0112671 A1 Apr. 24, 2014

(30) Foreign Application Priority Data

Oct. 24, 2012 (JP) ..... 2012-234518

(51) Int. Cl.
*G03G 15/00* (2006.01)

(52) U.S. Cl.
CPC ..... *G03G 15/553* (2013.01); *G03G 15/80* (2013.01); *G03G 2215/0141* (2013.01)

(58) Field of Classification Search
CPC ..... G03G 15/50; G03G 15/553; G03G 2215/0141; G03G 15/80
USPC ..... 399/9, 44, 13, 110
See application file for complete search history.

(56) References Cited

U.S. PATENT DOCUMENTS

2006/0193643 A1* 8/2006 Takagi et al. ..... 399/12
2008/0075502 A1 3/2008 Tada et al.
2011/0026946 A1* 2/2011 Okano ..... 399/27

FOREIGN PATENT DOCUMENTS

JP HEI 4-204559 A 7/1992
JP 2008-065122 A 3/2008

* cited by examiner

*Primary Examiner* — Rochelle-Ann J Blackman
(74) *Attorney, Agent, or Firm* — Scully, Scott, Murphy & Presser, P.C.

(57) ABSTRACT

An image forming apparatus is provided that includes an image forming unit including a process unit, a frame configured to hold the process unit detachably attached thereto, the frame including a first communication portion communicating with an outside of the frame in a first direction to detach the image forming unit from the frame, and a second communication portion communicating with the outside of the image forming apparatus in a second direction different from the first direction, and a material holder configured to hold material for image formation by the image forming unit and detachably attached to a predetermined portion of the frame that is close to the second communication portion relative to the voltage output terminal, so as to close the second communication portion.

13 Claims, 15 Drawing Sheets

IMAGE FORMING APPARATUS

CROSS-REFERENCE TO RELATED APPLICATION

This application claims priority under 35 U.S.C. §119 from Japanese Patent Application No. 2012-234518 filed on Oct. 24, 2012. The entire subject matter of the application is incorporated herein by reference.

BACKGROUND

1. Technical Field

The following description relates to one or more techniques for downsizing an image forming apparatus.

2. Related Art

An image forming apparatus has been known that employs a frame structure in which mutually-facing two side walls are connected via a plate-shaped joint portion, which separates a space for accommodating a plurality of photoconductive bodies from a space for accommodating a sheet tray.

SUMMARY

Nowadays, it has been required to downsize an image forming apparatus. Further, it has also been required to take in consideration safety in use of the image forming apparatus. Therefore, it has been needed to propose a new frame structure for the image forming apparatus that meets the downsizing requirement and such a safety requirement that each component constituting the image forming apparatus has to be disposed inside the frame.

Aspects of the present invention are advantageous to present one or more improved techniques to meet the aforementioned downsizing requirement and safety requirement for an image forming apparatus.

According to aspects of the present invention, an image forming apparatus is provided, which includes an image forming unit configured to perform image formation on a sheet, the image forming unit including a process unit, a frame configured to hold the process unit detachably attached thereto, the frame including a first communication portion configured to communicate with an outside of the frame in a first direction in which the image forming unit is allowed to be detached from the frame through the first communication portion, and a second communication portion configured to communicate with the outside of the image forming apparatus in a second direction different from the first direction, a voltage output terminal provided to the frame and configured to apply therethrough a voltage to one or more voltage loads including the image forming unit, and a material holder configured to hold material for the image formation by the image forming unit and detachably attached to a predetermined portion of the frame that is close to the second communication portion relative to the voltage output terminal, so as to close the second communication portion.

According to aspects of the present invention, further provided is an image forming apparatus including an image forming unit configured to perform image formation on a sheet, the image forming unit including a process unit, a frame configured to hold the process unit detachably attached thereto, the frame including a first communication portion configured to communicate with an outside of the image forming apparatus in a first direction in which the image forming unit is allowed to be detached from the frame through the first communication portion, and a second communication portion configured to communicate with the outside of the image forming apparatus in a second direction different from the first direction, a voltage output terminal provided to the frame and configured to apply therethrough a voltage to one or more voltage loads including the image forming unit, and a material holder configured to hold material for the image formation by image forming unit and detachably attached to a predetermined portion of the frame that is close to the second communication portion relative to the voltage output terminal, so as to close the second communication portion and prevent an external access to the voltage output terminal through the second communication portion, the material holder including at least one of a developer holder configured to hold development agent for the image formation, a sheet holder configured to hold the sheet to be fed to the image forming unit, and an image fixing unit configured to hold the sheet being conveyed therethrough and fix an image formed on the sheet by the image forming unit.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect. Aspects of the invention may be implemented on circuits (such as application specific integrated circuits) or in computer software as programs storable on computer readable media including but not limited to RAMs, ROMs, flash memories, EEPROMs, CD-media, DVD-media, temporary storage, hard disk drives, floppy drives, permanent storage, and the like.

Hereinafter, embodiments according to aspects of the present invention will be described with reference to the accompanying drawings.

First Embodiment

A first embodiment will be described with reference to FIGS. 1 to 14.

1. General Configuration of Printer

Figure 1:
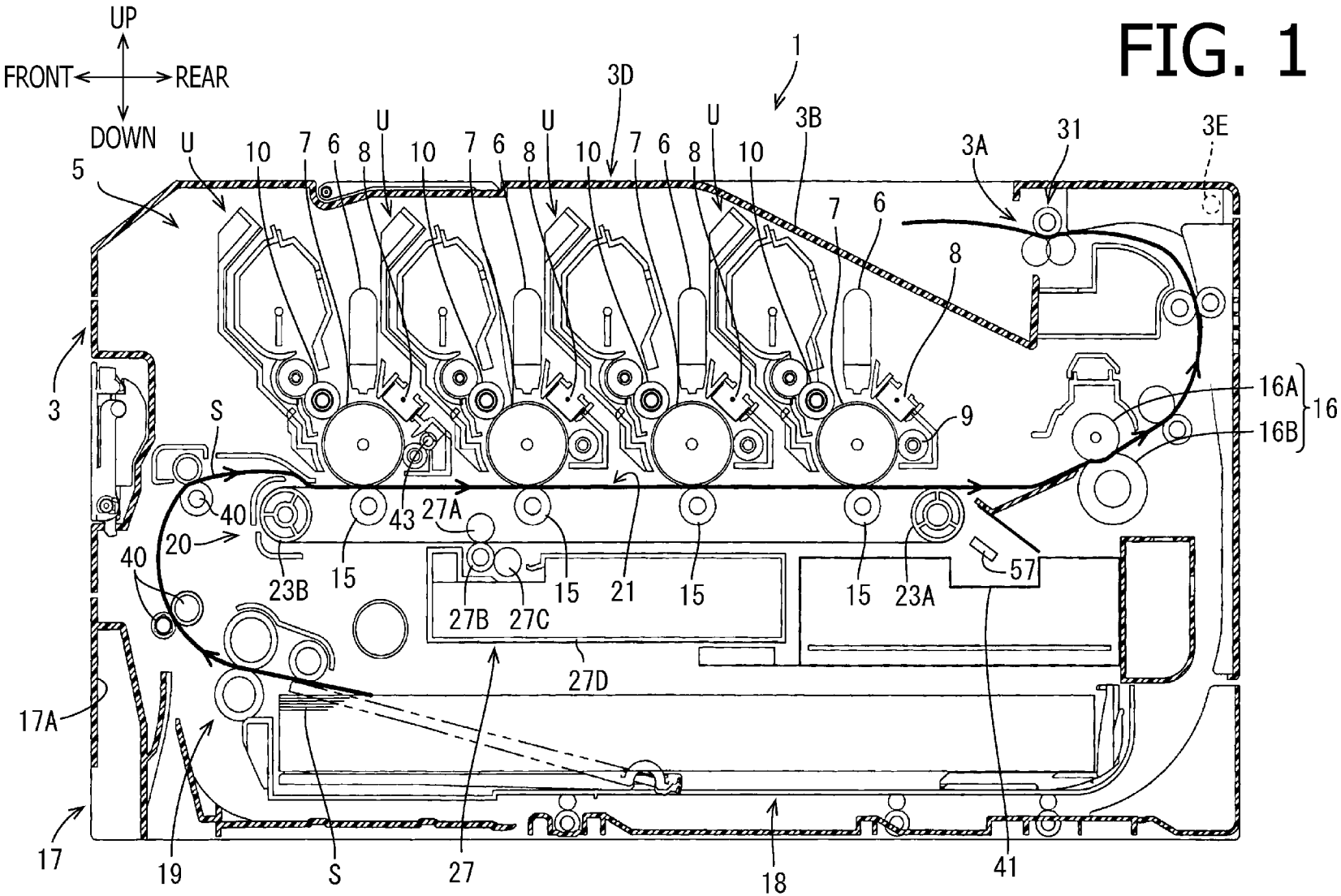
FIG. 1 is a cross-sectional side view schematically showing an internal configuration of a printer in a first embodiment according to one or more aspects of the present invention.
Figure 2:
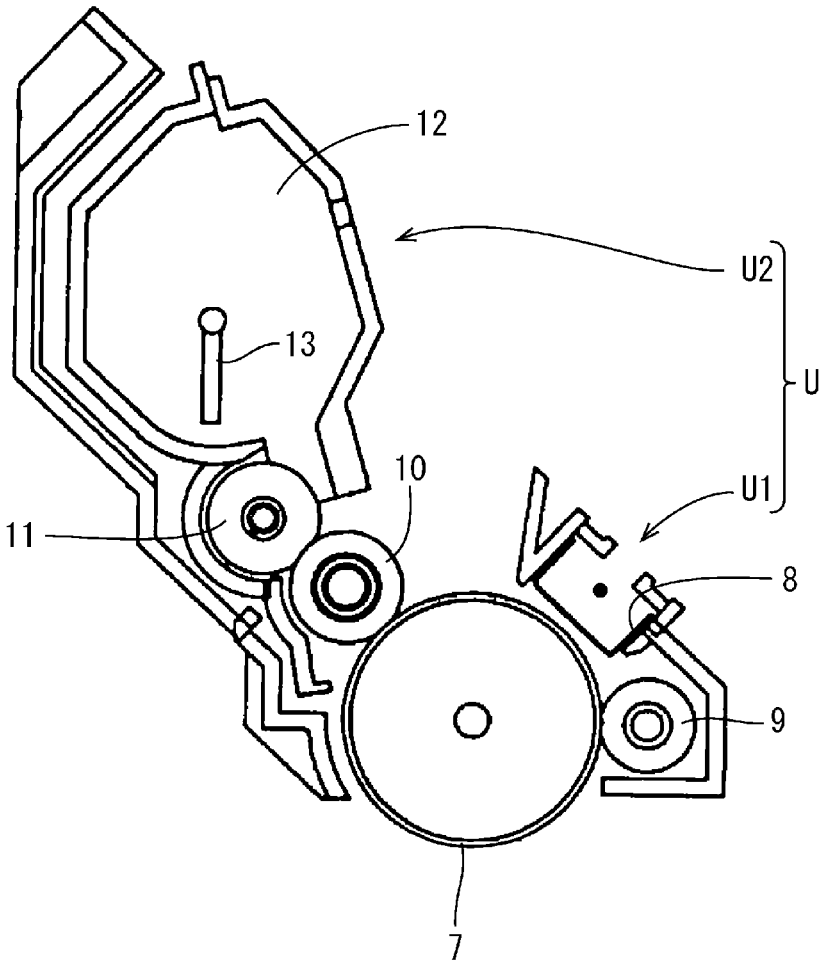
FIG. 2 is an enlarged cross-sectional view schematically showing a process unit detachably attached to a frame of the printer in the first embodiment according to one or more aspects of the present invention.

A printer 1 is a direct tandem type color printer that includes a plurality of process units (in the first embodiment, four process units) arranged in tandem along a conveyance direction of a sheet S. As shown in FIG. 1, the printer 1 has a housing 3, which contains therein a feed cassette 17 configured to hold and feed one or more sheets S (e.g., recording papers), an image forming unit 5 configured to form an image on a sheet S, a belt unit 20, and a fuser unit 16.

The feed cassette 17 is disposed at a bottom section of the housing 3, and includes a feed tray 18 configured to hold a stack of sheets S (e.g., recording papers) placed thereon, and a pick-up roller 19 configured to pick up and feed the sheets S placed on the feed tray 18. A sheet S fed from the feed tray 18 is conveyed to the image forming unit 5 via feed rollers 40 and a conveyance belt 21. Further, the feed cassette 17 includes a handle 17A provided at a front wall thereof, and is configured to be pulled out forward as a whole.

The image forming unit 5 includes exposure units 6 and process units U detachably attached to a frame 30. The process units U have the same configuration, except for a point that the process units U have respective different colors of toner stored therein and a point that a black process unit U (a leftmost process unit U in FIG. 1), disposed upstream in the conveyance direction of the sheet S relative to the other process units U, only has a sheet powder collecting roller 43 configured to contact a drum cleaning roller 9. Each process unit U includes a drum unit U1 and a toner unit U2 detachably attached to the drum unit U1 (see FIG. 2).

The drum unit U1 includes a photoconductive drum 7 configured to carry a developer image (a toner image), a charger 8, and a drum cleaning roller 9. The photoconductive drum 7 includes a cylindrical drum main body that has a photosensitive layer configured to be positively charged, and a metal drum shaft that extends along a center axis of the drum main body in a longitudinal direction of the drum main body.

Figure 4:
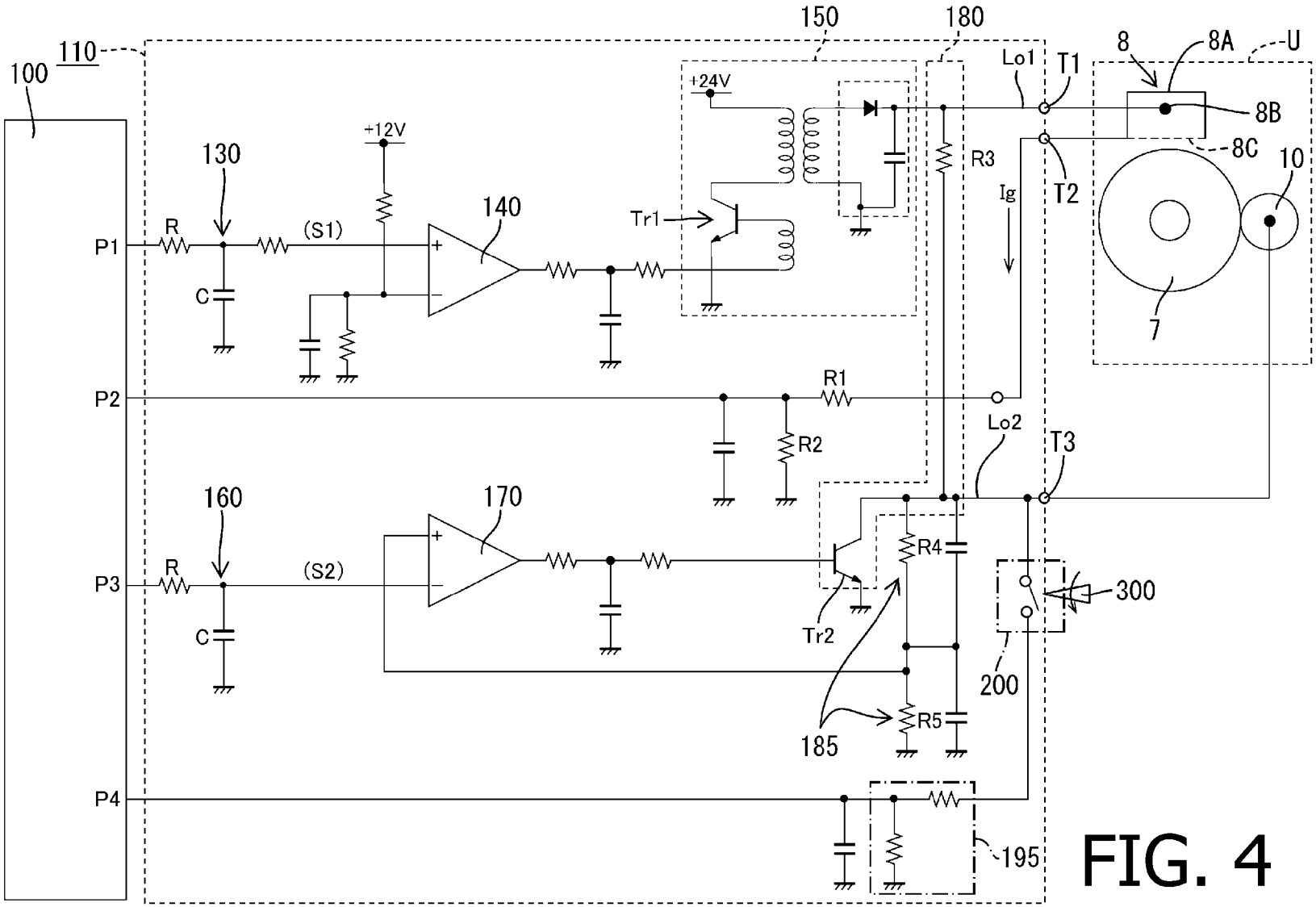
FIG. 4 is a circuit diagram of a high voltage power supply circuit (showing a feedback control system for controlling a grid current) for the printer in the first embodiment according to one or more aspects of the present invention.

The charger 8 is a scorotron type charger, and includes a shield case 8A, a wire 8B, and a metal grid electrode 8C (see FIG. 4). The shield case 8A is formed in a rectangular tube shape elongated in a rotational axis direction of the photoconductive drum 7. The shield case 8A has an opening provided as a discharge opening on a side facing the photoconductive drum 7.

The wire 8B is configured to generate corona discharge in the shield case 8A when supplied with a high voltage. Then, when ions caused by the corona discharge flow as a discharge electric current from the discharge opening to the photoconductive drum 7, a surface of the photoconductive drum 7 is charged evenly and positively. Further, the drum cleaning roller 9 is configured to electrostatically attract and remove substance (such as toner and sheet powder) adhering to the photoconductive drum 7 when supplied with a high voltage.

The toner unit U2 includes a development roller 10, a supply roller 11, and a toner container 12, so as to supply toner to the photoconductive drum 7. Specifically, the development roller 10 includes a roller shaft, and a rubber roller configured to cover a circumference of the roller shaft and made of a conductive rubber material. The toner container 12 is configured to store toner (development agent), and includes therein an agitator 13 configured to agitate the toner. The development roller 10 is configured to positively charge the toner supplied via the supply roller 11 by action of a development voltage Vd, and supply the positively charged toner onto the photoconductive drum 7.

The exposure unit 6 is provided for each individual photoconductive drum 7 and configured to expose the corresponding photoconductive drum 7. The exposure unit 6 includes a plurality of light emitting elements (e.g., LEDs) linearly arranged in parallel with the axial direction of the photoconductive drum 7.

As shown in FIG. 1, the belt unit 20 is disposed between the feed cassette 17 and the image forming unit 5, and includes a driving roller 23A, a driven roller 23B, a conveyance belt 21, and transfer rollers 15.

The driving roller 23A and the driven roller 23B are disposed in parallel with each other, to be spaced apart from each other in a front-to-rear direction. The conveyance belt 21 is wound around a pair of the driving roller 23A and the driven roller 23B. An upward-facing surface of the conveyance belt 21 contacts the photoconductive drums 7. Inside a space surrounded by the conveyance belt 21, each of the four transfer rollers 15 is disposed to face the corresponding photoconductive drum 7, so as to pinch the conveyance belt 21 with the corresponding photoconductive drum 7. Further, inside the space surrounded by the conveyance belt 21, disposed is a backup roller 27A that is one of elements constituting a belt cleaner 27. The backup roller 27A is integrated with the belt unit 20 and configured to be attached to and detached from the housing 3, integrally with the belt unit 20.

The fuser unit 16 is disposed behind the belt unit 20 (on a right side in FIG. 1). The fuser unit 16 includes a heating roller 16A configured to rotate while heating (thermally fixing) the developer image transferred onto the sheet S, and a pressing roller 16B configured to press the sheet S against the heating roller 16A.

A general explanation will be provided about a series of image forming operations by the printer 1 configured as above. Upon receipt of print data D (see FIG. 3), the printer 1 starts a printing process. Thereby, the surface of each photoconductive drum 7, which is rotating, is evenly and positively charged by the corresponding charger 8. Then, the surface of the photoconductive drum 7 is exposed by the corresponding exposure unit 6 in accordance with the print data. Thereby, on the surface of the photoconductive drum 7, formed is a predetermined electrostatic latent image according to the print data. In other words, an electric potential of the exposed portion of the evenly and positively charged surface of each photoconductive drum 7 drops.

Subsequently, in response to rotation of the development roller 10, the positively charged toner carried on the development roller 10 is supplied to the electrostatic latent image formed on the surface of the photoconductive drum 7. Thereby, the electrostatic latent image on the photoconductive drum 7 is visualized, and a toner image is carried on the surface of the photoconductive drum 7 as a result of a reversal phenomenon.

Then, when the sheet S fed from the feed cassette 17 passes between each photoconductive drum 7 and the corresponding transfer roller 15 dispose inside the space surrounded by the conveyance belt 21, the toner image formed on each photoconductive drum 7 is transferred onto the sheet S. Afterward, when the sheet S passes between the heating roller 16A and the pressing roller 16B, the toner image transferred onto the sheet S is thermally fixed. The sheet S fed from the fuser unit 16 is turned around with a conveyance direction thereof changed by an angle of 180 degrees, and is ejected from an ejection unit 3A disposed at an upper section of the housing 3 onto a catch tray 3B.

Further, in an opposite position (a lower side in FIG. 1) of the photoconductive drum 7 with respect to the belt unit 20, disposed is the belt cleaner 27 configured to remove substance adhering to the conveyance belt 21. The belt cleaner 27 includes the backup roller 27A, a cleaning roller 27B, a collecting roller 27C, and a waste toner box 27D.

The backup roller 27A and the cleaning roller 27B are disposed to face each other across the conveyance belt 21. When a high voltage is applied to the backup roller 27A, generated is an electric field from the backup roller 27A toward the cleaning roller 27B. By action of the electric field, substance (such as toner and sheet powder) adhering onto the conveyance belt 21 is electrostatically attracted by the cleaning roller 27B. After attracted by the cleaning roller 27B, the substance is collected by the collecting roller 27C, and put into the waste toner box 27D.

2. Electrical Configuration of Printer

Figure 3:
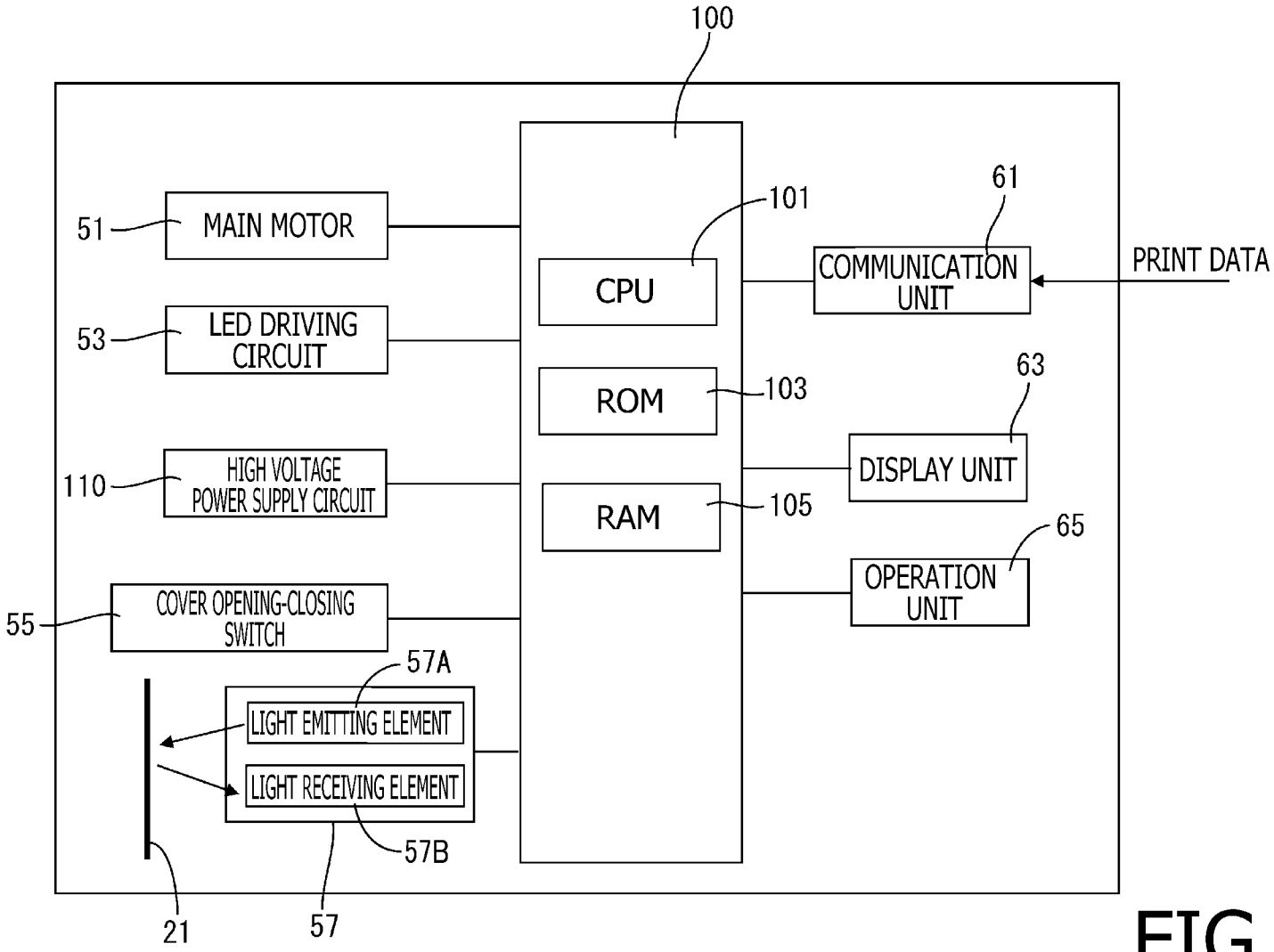
FIG. 3 is a block diagram schematically showing an electrical configuration of the printer in the first embodiment according to one or more aspects of the present invention.

Subsequently, an electrical configuration of the printer 1 will be described with reference to FIG. 3. The printer 1 includes a main motor 51, an LED driving circuit 53 configured to drive the LEDs of the exposure unit 6, a high voltage power supply circuit 110, a cover opening-closing switch 55, a density sensor 57, a communication unit 61, a display unit 63, an operation unit 65, and a controller 100.

The main motor 51 is configured to drive and rotate rotatable bodies, which include rotatable bodies of the process units U such as the photoconductive drums 7, the development rollers 10, and the supply rollers 11, and rotatable bodies for sheet conveyance such as the pickup roller 19 and feed rollers.

The high voltage circuit 110 is configured to generate high voltage to be supplied to the chargers 8, the drum cleaning rollers 9, the development rollers 10, and the belt cleaner 27. The cover opening-closing switch 55 includes a contact point configured to switch between an ON state and an OFF state in response to an upper cover 3D being opened and closed. The cover opening-closing switch 55 is configured to detect movement of the upper cover 3D from an open position to a closed position. Specifically, when the upper cover 3D moves from the open position to the closed position, a pressing portion 56 provided at a side of the upper cover 3D presses the cover opening-closing switch 55. Thereby, the cover opening-closing switch 55 switches from the OFF state to the ON state.

The density sensor 57 includes a light emitting element 57A configured to emit light to the conveyance belt 21, and a light receiving element 57B configured to receive light reflected by the conveyance belt 21. The density sensor 57, which is for detecting a density of toner, is configured to receive light reflected by an image formed on the conveyance belt 21, and determine the density of toner based on a light receiving signal issued in response to receipt of the reflected light.

It is noted that the printer 1 is configured to detect existence of the belt unit 20 using the density sensor 57. Specifically, the printer 1 is configured to detect existence of the belt unit 20 based on whether or not detected is a light receiving signal output from the light receiving element in response to the light emitting element emitting light.

The controller 100 includes a CPU 101, a ROM 103, and a RAM 105. The ROM 103 is configured to store programs such as a program for executing the printing process and a program for executing an electric shock preventing sequence (e.g., a below-mentioned execution sequence of a warm-up operation). Further, the RAM 105 is configured to store various types of data.

The controller 100 is configured to take overall control of the printer 1 to perform a series of image forming operations and perform an execution sequence for executing a warm-up operation. Further, the communication unit 61 is configured to perform communication with an information terminal device such as a PC, and receive a print instruction and print data from the information terminal device. The display unit 63 includes a liquid crystal display (LCD) and lamps, and is configured to display various setting screens and operating statuses via the LCD and the lamps.

3. Configuration of High Voltage Power Supply Circuit

As shown in FIG. 4, the high voltage power supply circuit 110 includes a first PMW signal smoothing circuit 130, an amplifier 140, a charge voltage applying circuit 150, a second PMW signal smoothing circuit 160, an amplifier 170, and a development voltage applying circuit 180.

The first PMW signal smoothing circuit 130 is an integration circuit including a resistor R and a capacitor C, and is configured to smooth a PMW signal S1 output from a PWM port P1 of the controller 100. There is an amplifier 140 disposed on an output side of the first PMW signal smoothing circuit 130. The PMW signal S1 smoothed by the first PWM signal smoothing circuit 130 is amplified by the amplifier 140, and thereafter input to a base of a transistor Tr1 provided in the charge voltage applying circuit 150.

The charge voltage applying circuit 150 is configured to generate a high voltage of 6 kV to 8 kV from an input voltage of DC 24 V, and apply the generated high voltage to the charger 8. In the first embodiment, a self-excited flyback converter (e.g., a ringing choke converter (RCC)) is employed for the charge voltage applying circuit 150. An output line Lo1 of the charge voltage applying circuit 150 is connected with the wire 8B of the charger 8 via a high voltage output terminal T1 provided to the frame 30. Thereby, an output voltage Vo from the charge voltage applying circuit 150 is applied to the wire 8B of the charger 8.

Further, the grid electrode 8C of the charger 8 is connected with ground via a resistor R1 and a resistor R2. Additionally, a connection point between the resistors R1 and R2 is connected with an input port P2 of the controller 100 via a signal line. Thereby, the controller 100 is allowed to detect how high a grid current Ig flowing through the grid electrode 8C of the charger 8 is, by checking a voltage level of the input port P2.

The controller 100 is configured to control the grid current Ig flowing through the grid electrode 8C of the charger 8 to be equal to a reference value, by adjusting a duty ratio of the PMW signal S1 output from the PWM port P1 while monitoring the voltage level of the input port P2 and adjusting the output voltage Vo from the charge voltage applying circuit 150.

The development voltage applying circuit 180 is configured to apply the development voltage Vd to the roller shaft of the development roller 10, and includes a resistor R3 and a control transistor Tr2. The resistor R3 has an end connected with the output line Lo1 of the charge voltage applying circuit 150. The control transistor Tr2 is an NPN transistor with a collector connected with another end of the resistor R3 and an emitter connected with ground.

From a connection point between the control transistor Tr2 and the resistor R3, an output line Lo2 extends, which is connected the roller shaft of the development roller 10 via a high voltage output terminal T2 provided to the frame 30. According to the aforementioned electrical configuration, it is possible to control the development voltage Vd to be applied to the development roller 10, by adjusting the voltage to be applied to a base of the control transistor Tr2. It is noted that the development voltage Vd to be applied to the development roller 10 is a voltage obtained by subtracting a voltage drop caused due to the resistor R3 from the output voltage Vo from the charge voltage applying circuit 150. A target value of the development voltage Vd may be within a range of about 400 V to 500 V.

An input port P4 of the controller 100 is electrically connected with the output line Lo2 of the development voltage applying circuit 180 via a voltage-dividing circuit 195 and a contact point 200. When a detecting operation, in which the main motor 51 is caused to rotate, is performed in a situation where there is not a toner unit U2 attached to the drum unit U1, the contact point 200 is in an OFF state (a non-contact state), and a voltage level of the input port P4 is a low level (pattern 1 in FIG. 14). Meanwhile, in a situation where an old toner unit U2 is attached to the drum unit U1, the contact point 200 is in an ON state (a contact state), and the voltage level of the input port P4 is a high level (pattern 2 in FIG. 14). Further, in a situation where a new toner unit U2 is attached to the drum unit U1, the state of the contact point 200 varies in an order of the ON state→the OFF state→the ON state, and the voltage level of the input port P4 changes in an order of the high level→the low level→the high level (pattern 3 in FIG. 14).

Therefore, by determining in which pattern the voltage of the input port P4 changes when the detecting operation in which the main motor 51 is caused to rotate is performed, it is possible to determine whether there is a toner unit U2 attached to the drum unit U1, or whether the toner unit U2 attached to the drum unit U1 is new or old.

In addition, a reset gear 300 may be exemplified as a mechanism for switching the contact point 200 between the ON state and the OFF state in response to the detecting operation. In the first embodiment, the reset gear 300 is provided to the toner unit U2. The reset gear 300 is configured to rotate only once in response to the main motor 51 being driven to rotate when a new toner unit U2 is attached, and to change the state of the contact point 200 in the order of the ON state→the OFF state→the ON state. The reset gear 300, which has already rotated, is separated from a power transmission system for the main motor 51, and causes the contact point 200 to stay in the ON state. Therefore, when an old toner unit U2 is attached, the contact point 200 maintains the ON state, regardless of the rotation of the main motor 51. Meanwhile, when there is not a toner unit U2 attached, the contact point 200 is released from the state where the contact point 200 is caused to stay in the ON state by the reset gear 200, and maintains the OFF state.

Figure 5:
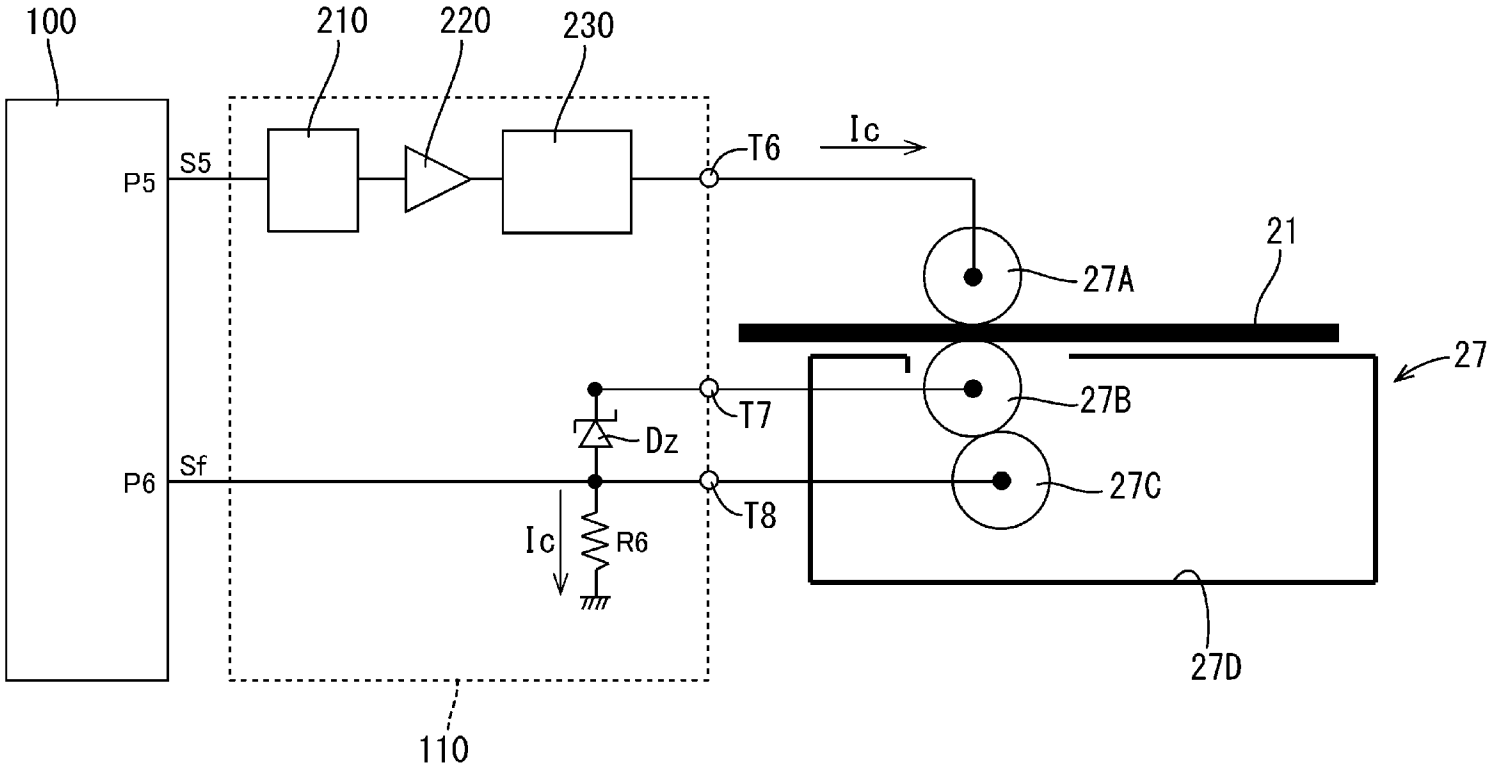
FIG. 5 is a circuit diagram of the high voltage power supply circuit (showing a feedback control system for controlling a belt cleaning current) for the printer in the first embodiment according to one or more aspects of the present invention.

As shown in FIG. 5, the high voltage power supply circuit 110 includes a third PWM signal smoothing circuit 210, an amplifier 220, and a cleaner voltage applying circuit 230. The third PWM signal smoothing circuit 210 is an integration circuit including a resistor and a capacitor, and is configured to smooth a PWM signal S5 output from a PWM port P5 of the controller 100. There is an amplifier 220 disposed on an output side of the third PMW signal smoothing circuit 210. The PMW signal S5 smoothed by the third PWM signal smoothing circuit 210 is amplified by the amplifier 220, and thereafter input to the cleaner voltage applying circuit 230.

The cleaner voltage applying circuit 230 is configured to generate a high voltage of about 1.2 kV from an input voltage of DC 24 V in response to the input value from the amplifier 220, and apply the high voltage to a roller shaft of the backup roller 27A via a high voltage output terminal T6 provided to the frame 30. Further, as shown in FIG. 5, a zener diode DZ is connected between a roller shaft of the cleaning roller 27B and a roller shaft of the collecting roller 27C. Thus, when the high voltage is applied to the backup roller 27A, a voltage of about 400 V is generated between the cleaning roller 27B and the collecting roller 27C.

The zener diode DZ is connected with ground via a current detecting resistor R6. A connection point between the current detecting resistor R6 and the zener diode DZ is connected with an input port P6 of the controller 100 via a signal line. Thereby, to the input port P6 of the controller 100, a feedback signal Sf is input, which is proportional to a voltage of the current detecting resistor R6, i.e., to a value of a cleaning current Ic to be output from the high voltage output terminal T6 and flow through the cleaning roller 27B.

The controller 100 is configured to control the cleaning current Ic to be equal to a reference value during a cleaning operation, by, while monitoring the feedback signal Sf input to the input port P6, adjusting a PWM value (a duty ratio) of the PWM signal S5 output from the PWM port P5 and adjusting an output voltage from the cleaner voltage applying circuit 230.

4. Structure of Frame

Figure 6:
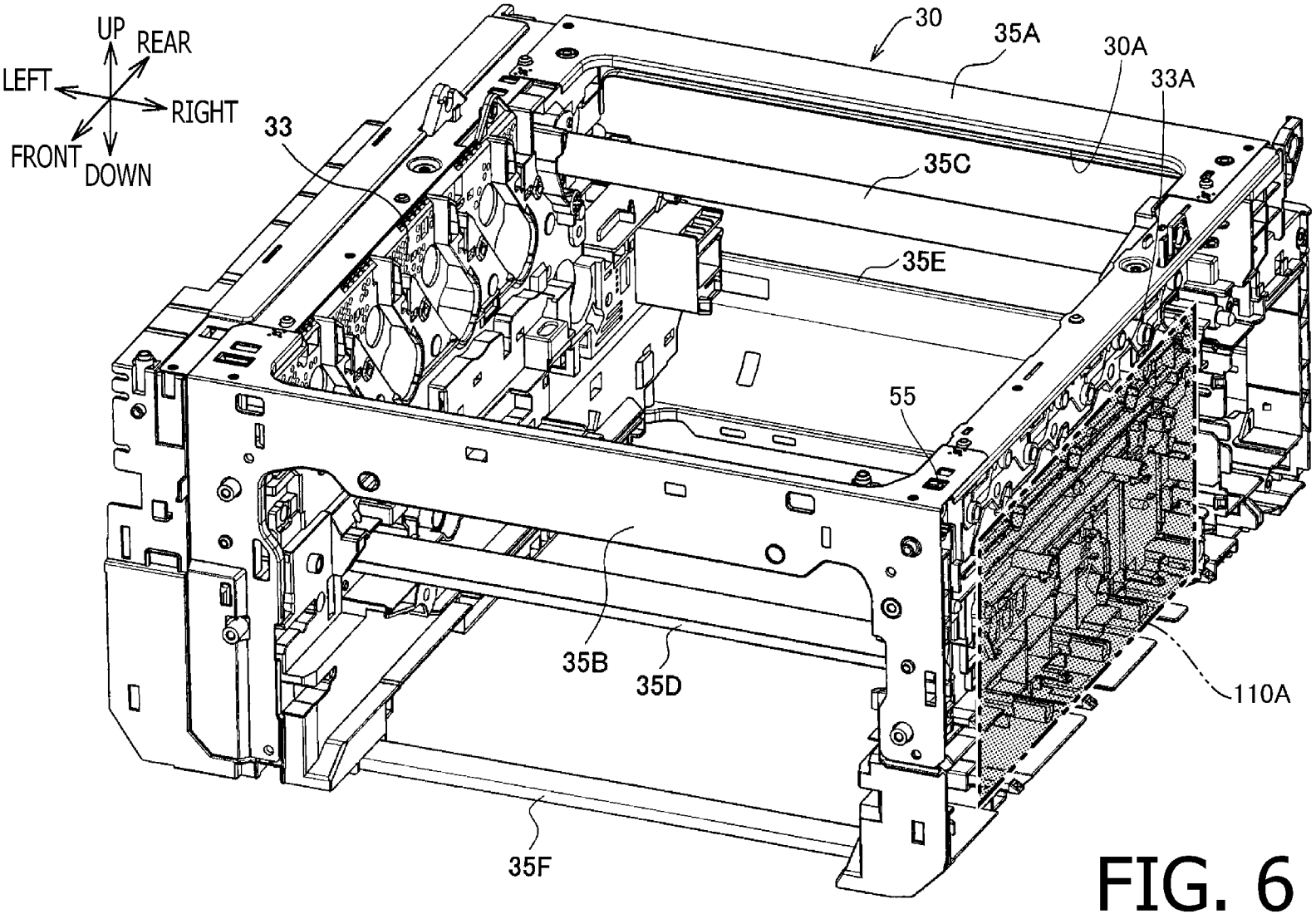
FIG. 6 is a perspective view of the frame in the first embodiment according to one or more aspects of the present invention.

The frame 30 of the printer 1 includes two main frames 33 and a plurality of sub frames 35A, 35B, 35C, 35D, 35E, and 35F. As shown in FIG. 6, the two main frames 33 are disposed to face each other and spaced apart from each other in a horizontal direction (a left-to-right direction in FIG. 6). Each main frame 33 is a substantially plate-shaped resin member, and is formed integrally with a plurality of reinforcement projections protruding from a plate surface. Further, on an outer face side of a main frame 33A on a right side in FIG. 6, disposed is a high voltage board 110A with the high voltage power supply circuit 100 mounted thereon.

Each of the sub frames 35A, 35B, 35C, 35D, 35E, and 35F is a beam-shaped member extending to bridge a distance between the two main frames 33, and is configured to hold a relative positional relationship between the two main frames 33. Further, the two main frames 33 form an internal space therebetween that accommodates the feed cassette 17, the belt unit 20, and the image forming unit 5. Namely, the two main frames 33 are disposed to face each other across the feed cassette 17, the belt unit 20, and the image forming unit 5 in the horizontal direction (the left-to-right direction in FIG. 6).

Figure 7:
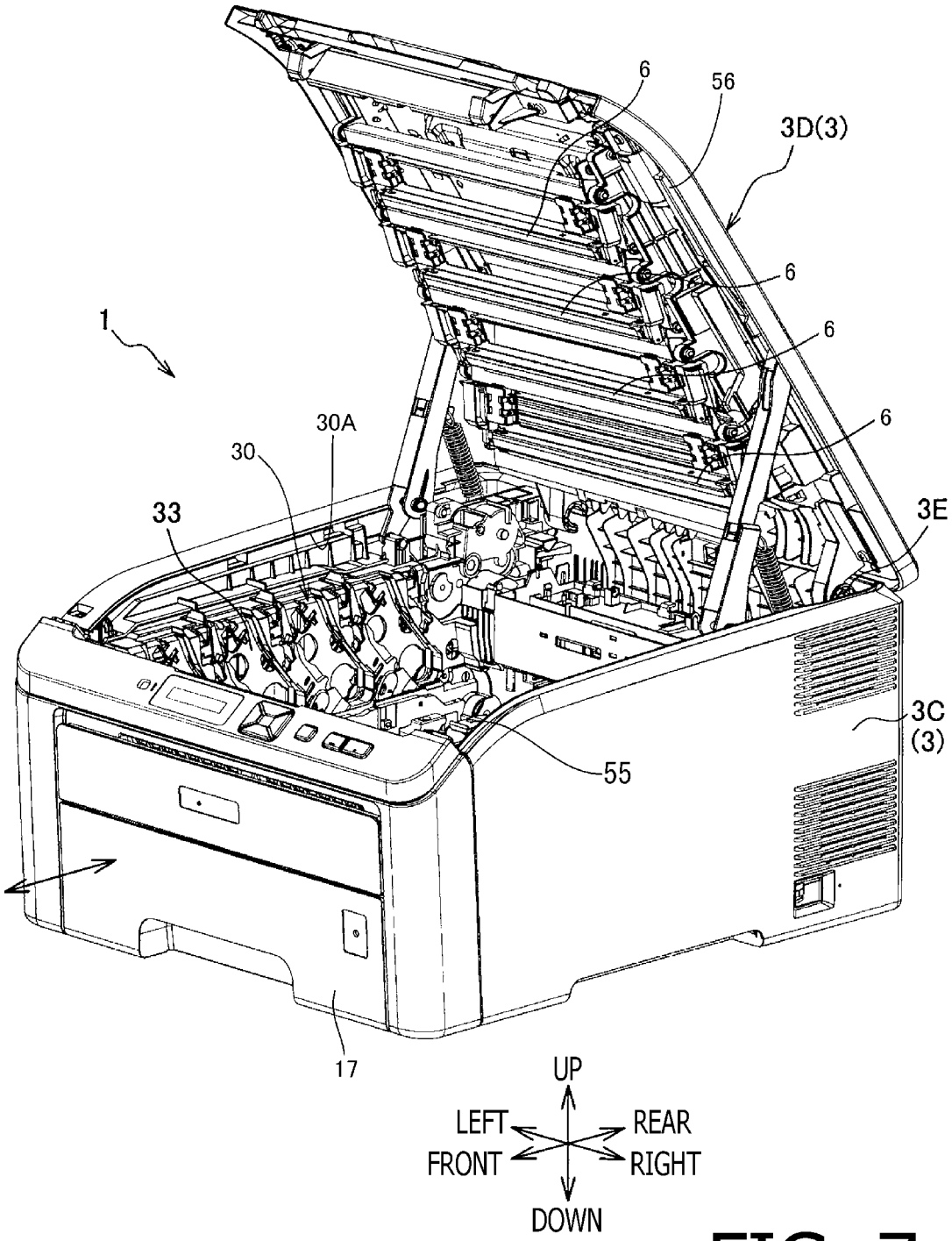
FIG. 7 is a perspective view showing a housing of the printer in a state where an upper cover is open in the first embodiment according to one or more aspects of the present invention.

As shown in FIG. 7, the frame 30 is covered with side covers 3C and an upper cover 3D that constitute the housing 3. The upper cover 3D is swingably attached to an upper rear side of the frame 30 via a swing shaft 3E, and is configured to move between an open position where an upper side of the frame 30 is open and a closed position where the upper side of the frame 30 is closed (see FIG. 1).

At the upper side of the frame 30, a first communication portion 30A is provided that includes an opening formed to be open upward into an outside of the frame 30 (an outside of the printer 1) and communicate with the outside of the frame 30. When the upper cover 3D is open, the internal space of the frame 30 is allowed to communicate with the outside of the frame 30 via the first communication portion 30A. Therefore, a user is allowed to sequentially detach the process units U and the belt unit 20 from the frame 30 through the first communication portion 30A. Meanwhile, the frame 30 is configured to form a bottom section for accommodating the feed cassette 17. The feed cassette 17 is configured to be detached from the frame 30 by an operation from a front side of the frame 30.

Figure 8:
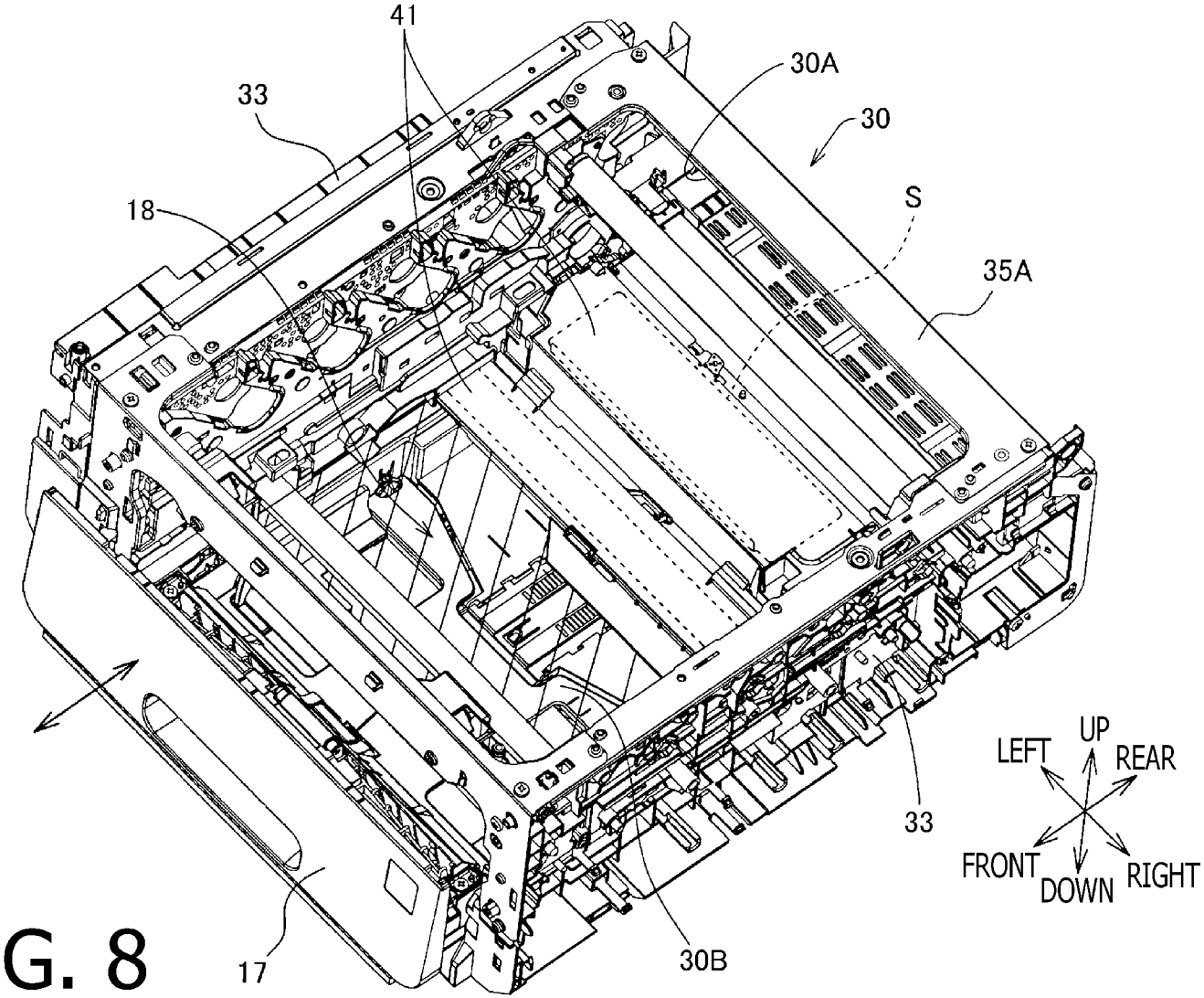
FIG. 8 is a perspective view of the frame in a state where the process units and a belt unit are removed therefrom in the first embodiment according to one or more aspects of the present invention.

Further, as shown in FIG. 8, on a rear side, relative to a center portion, of a space between the feed cassette 17 and the belt unit 25, attached are various circuit boards and covers 41 for covering the circuit boards. Thus, the covers 41 separate a space for accommodating the belt unit 25 from a space for accommodating the feed cassette 17 in a vertical direction.

Meanwhile, on a front side, relative to the covers 41, of the space between the feed cassette 17 and the belt unit 25, there is not a partition but a second communication portion 30B provided to achieve communication between the space for accommodating the belt unit 25 and the space for accommodating the feed cassette 17 (namely, the space for accommodating the belt unit 25 and the space for accommodating the feed cassette 17 open into each other via the second communication portion 30B). In FIG. 8, the second communication portion 30B is marked with diagonal lines. It is noted that FIG. 8 is a perspective view showing the frame 30 in a state where the process units U and the belt unit 25 are removed therefrom.

5. Structure for Electric Shock Prevention

Figure 9:
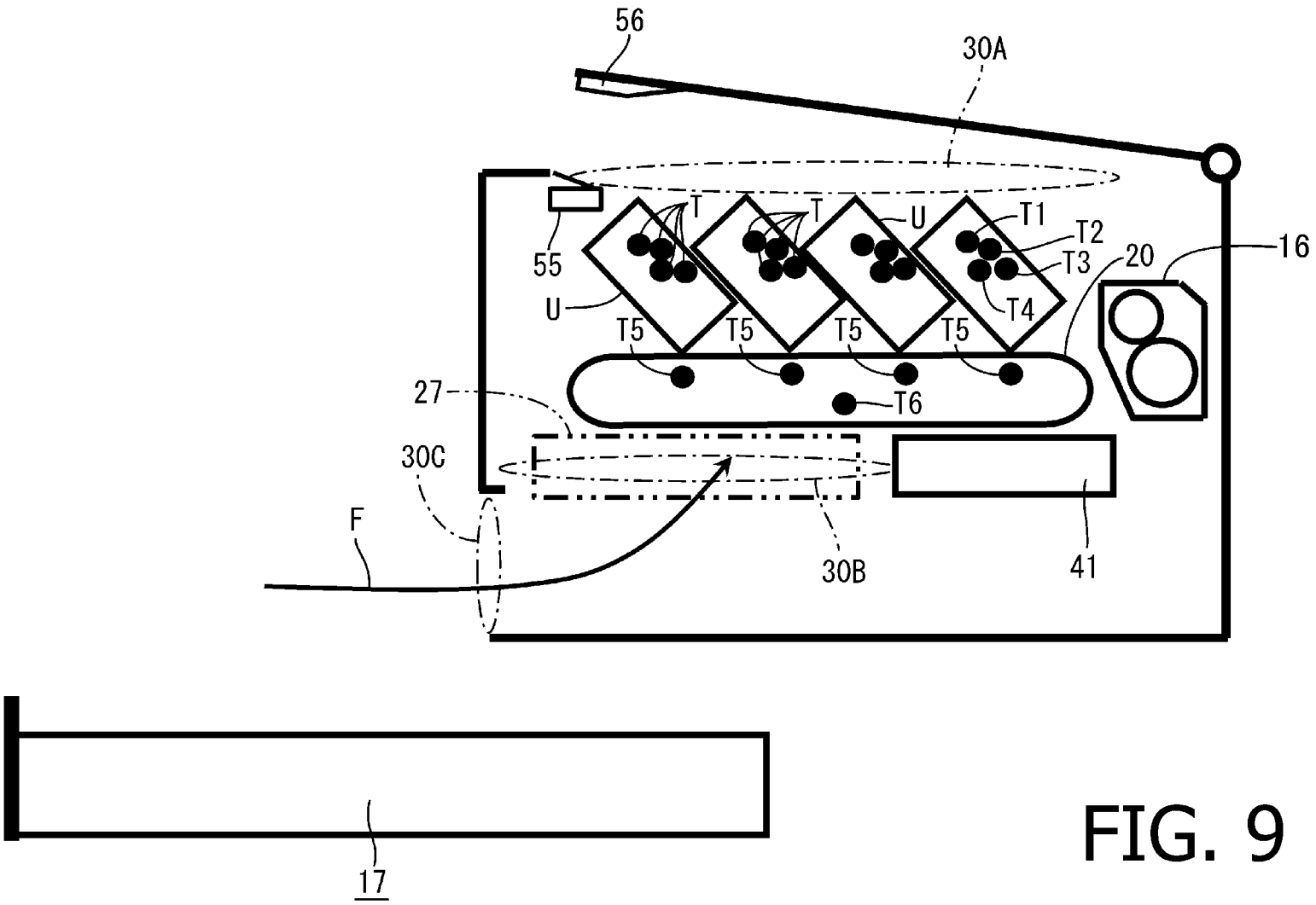
FIG. 9 is a view schematically showing a layout of a second communication portion and other surrounding components of the printer in the first embodiment according to one or more aspects of the present invention.

When the feed cassette 17 is detached from the frame 30, as shown in FIG. 9, the second communication portion 30B is allowed to open into and communicate with the outside of the frame 30 via a cassette detachment opening 30C formed to open forward at a front wall of the frame 30. Therefore, as indicated by an arrow F in FIG. 9, the user might insert his (her) hand into an inside of the frame 30 from the cassette detachment opening 30C via the second communication portion 30B.

Meanwhile, on an inner wall of the right main frame 33A shown in FIG. 6, the high voltage output terminals T1 to T6 (collectively referred to as the high voltage output terminals T) are provided. The high voltage output terminals T1 to T6 are terminals for applying a high voltage to high voltage loads. The high voltage loads may include loads configured to be supplied with a voltage equal to or higher than 100 V, such as the wires 8B and the grid electrodes 8C of the chargers 8, the development rollers 10, the photoconductive drums 7, the transfer rollers 15, and the backup roller 27A of the belt cleaner 27. When the high voltage loads are attached to the frame 30, each high voltage load is connected with the high voltage power supply circuit 110 of the high voltage board 110A disposed on an outer side of the main frame 33A, via the corresponding high voltage output terminal T. The high voltage output terminals T1 to T6 are attached to positions, on the inner wall of the main frame 33A, corresponding to attachment positions of the high voltage loads, respectively.

When the process units U or the belt unit 20 are not attached, the high voltage terminals T are exposed. Hence, when the user inserts his (her) hand into the inside of the frame 30 via the second communication portion 30B, the user's hand might touch the exposed high voltage terminals T.

Figure 10:
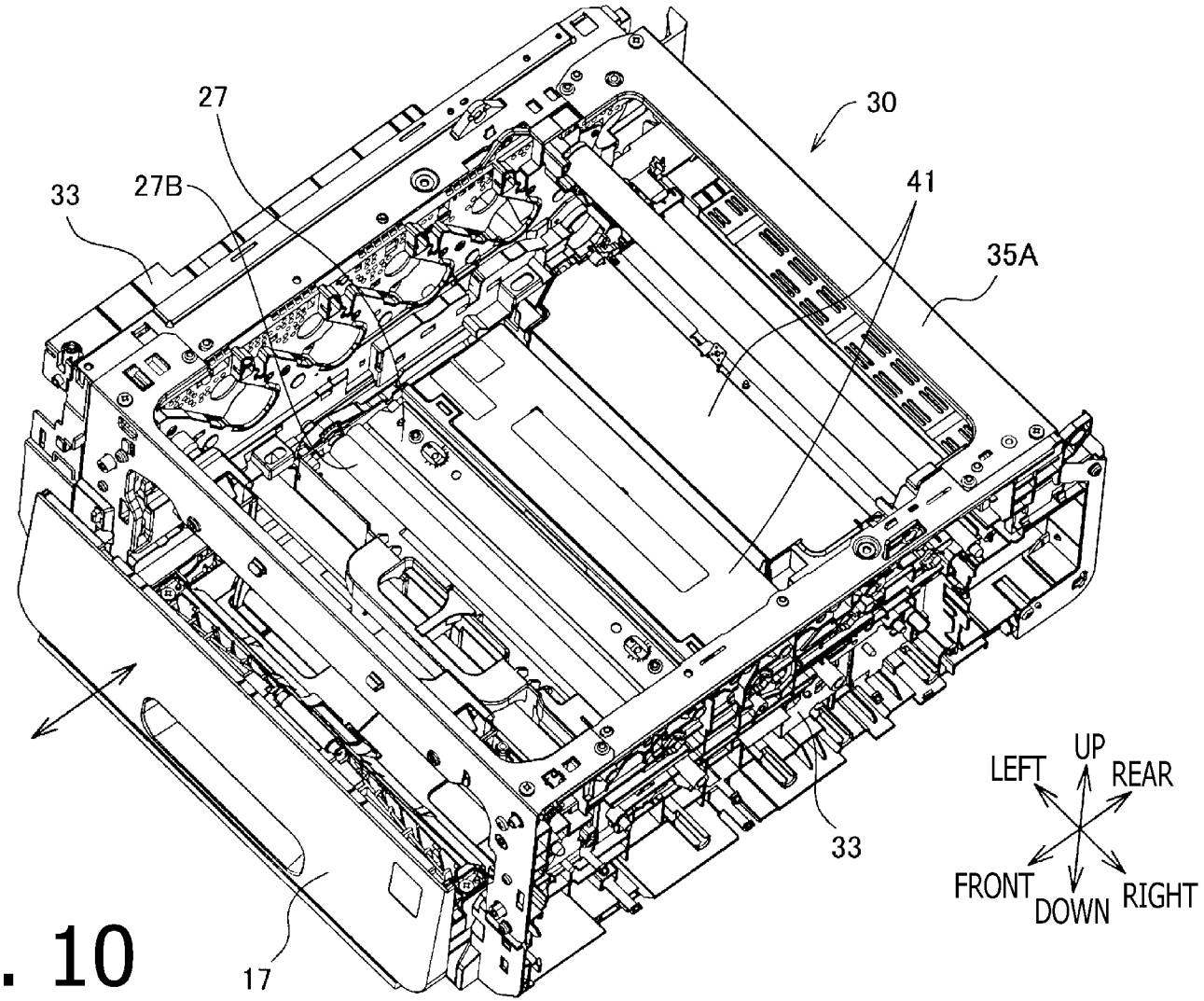
FIG. 10 is a perspective view showing the frame in a state where a cleaner is disposed at the second communication portion in the first embodiment according to one or more aspects of the present invention.

In view of the above problem, in the printer 1, as shown in FIGS. 9 and 10, the waste toner box 27D of the belt cleaner 27 is disposed in such a position between the feed cassette 17 and the belt unit 20 as to close the second communication portion 30B. In other words, the waste toner box 27D of the belt cleaner 27 is disposed to close the second communication portion 30B, on a side of the second communication portion 30B when viewed from the high voltage output terminals T (on a side of the second communication portion 30B with respect to the high voltage output terminals T).

Thus, according to the configuration that the waste toner box 27D is disposed to close the second communication portion 30B, even though the process units U or the belt unit 20 are not attached, and the high voltage output terminals T are exposed, it is possible to prevent the user's hand from touching the exposed high voltage output terminals T. In other words, as the waste toner box 27D is disposed to close the second communication portion 30B, it is possible to prevent an external access to the high voltage output terminals T through the second communication portion 30B.

When the upper cover 3D is opened, and the process units U and the belt unit 20 (including the backup roller 27A) are sequentially removed, an upper side of the belt cleaner 27 is rendered open. In this situation, it is possible to detach the belt cleaner 27 including the waste toner box 27D via the first communication portion 30A.

6. Execution Sequence of Warm-Up Operation

Figure 12:
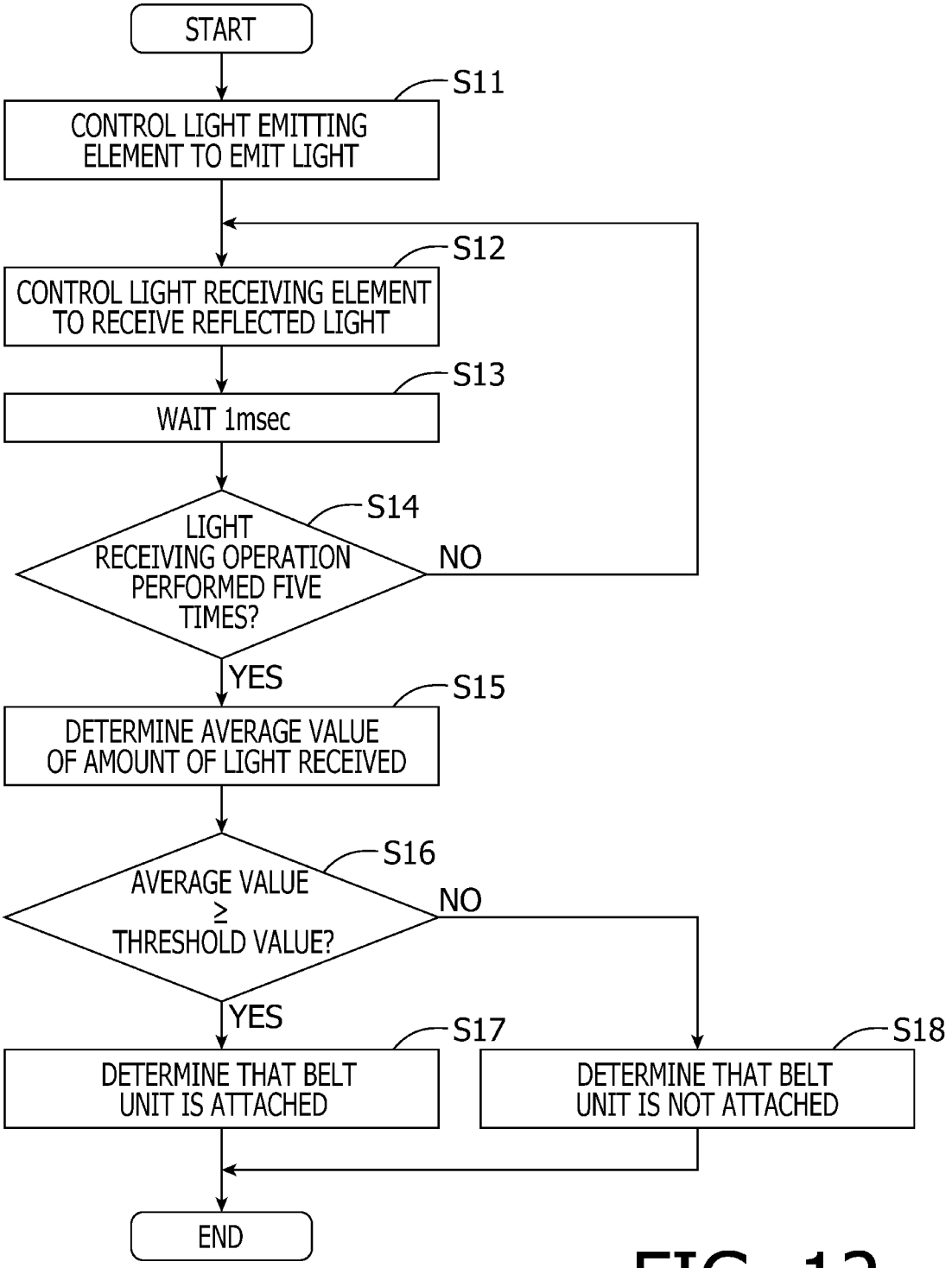
FIG. 12 is a flowchart showing a procedure of a belt-unit detecting process in the first embodiment according to one or more aspects of the present invention.
Figure 13:
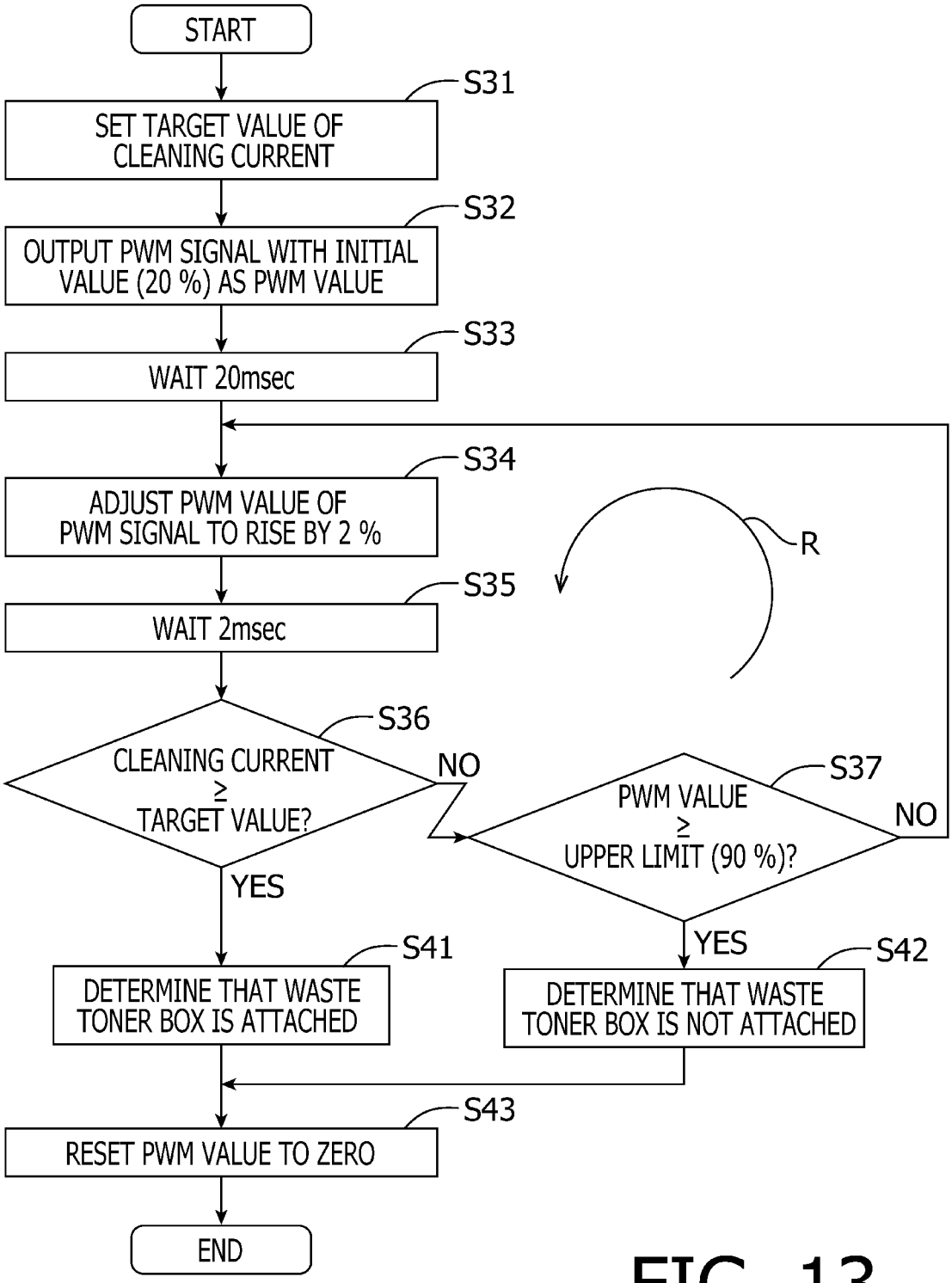
FIG. 13 is a flowchart showing a procedure of a waste-toner-box detecting process in the first embodiment according to one or more aspects of the present invention.
Figure 14:
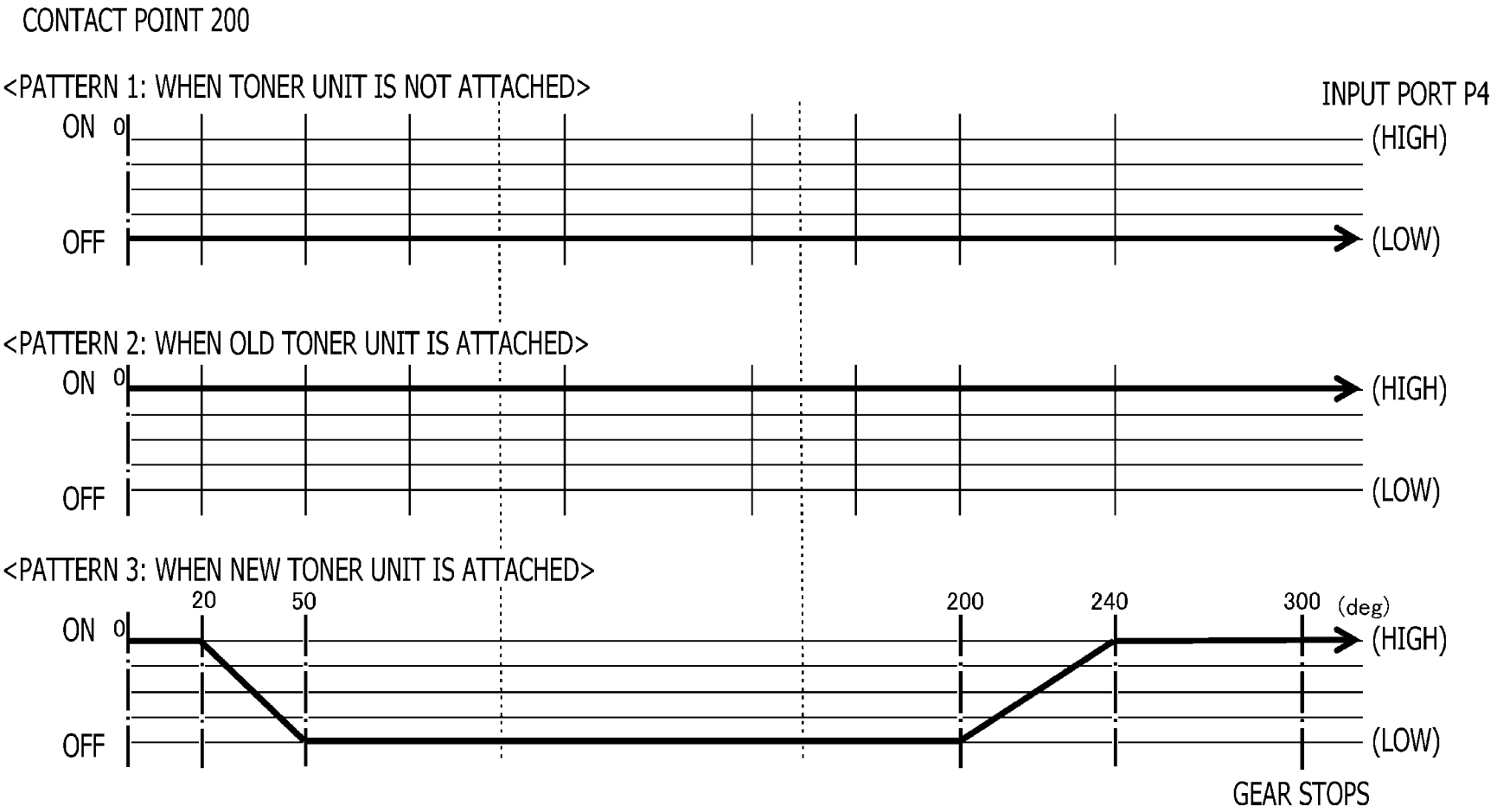
FIG. 14 is a timing chart showing voltage variation patterns of an input port in response to an ON/OFF state of a contact point in the first embodiment according to one or more aspects of the present invention.

Subsequently, an explanation will be provided about the execution sequence for executing the warm-up operation by the controller 100, with reference to FIGS. 11, 12, and 13. The warm-up operation is carried out before printing. The execution sequence of the warm-up operation is launched in response to the printer 1 being powered on or the cover opening-closing switch 55 detecting the movement of the upper cover 3D from the open position to the closed position.

In response to detection of the movement of the upper cover 3D from the open position to the closed position, in S10, the controller 100 performs a belt-unit detecting process to detect the belt unit 20. The belt-unit detecting process includes steps S11 to S18 shown in FIG. 12.

In S11, the controller 100 performs a light emitting operation to control the light emitting element 57A of the density sensor 57 to emit light. Next, in S12, the controller 100 performs a light receiving operation to control the light receiving element 57B of the density sensor 57 to receive reflected light from the conveyance belt 21 (specifically, light emitted toward the conveyance belt 21 by the light emitting element 57A and reflected by a surface of the conveyance belt 21 or an inner wall of the frame 30). Subsequently, in S13, the controller 100 waits for a time period of 1 msec. Afterward, in S14, the controller 100 determines whether the light receiving operation has been performed five times.

When determining that the light receiving operation has not been performed five times (the number of the light receiving operations has not reached five) (S14: No), the controller 100 goes back to S12, in which the controller 100 performs the light receiving operation. Thus, the controller 100 repeatedly performs the light receiving operation five times at time intervals of 1 msec.

Meanwhile, when determining that the light receiving operation has been performed five times (the number of the light receiving operations has reached five) (S14: Yes), the controller 100 goes to S15. In S15, the controller 100 determines an average value of an amount of light received by the light receiving element 57B, from the respective amounts of light received in the five light receiving operations. At this time, the average value is determined with a maximum value and a minimum value being excluded from the sampled amounts of light received, so as to achieve high accuracy of the determined average value.

Afterward, in S16, the controller 100 determines whether the determined average value of the amounts of light received is equal to or more than a threshold value. When determining that the determined average value of the amounts of light received is equal to or more than the threshold value (S16: Yes), the controller 100 determines that there is a belt unit 20 attached to the frame 30 (S17). Meanwhile, when determining that the determined average value of the amounts of light received is not equal to or more than the threshold value (the determined average value of the amounts of light received is less than the threshold value) (S16: No), the controller 100 determines that there is not a belt unit 20 attached to the frame 30 (S18).

Thus, the comparison between the average value of the amounts of light received and the threshold value makes it possible to determine whether the belt unit 20 is attached or not, for the following reasons. When the belt unit 20 is attached to the frame 30, the light emitted by the light emitting element 57A is reflected by the surface of the conveyance belt 21, and is received by the light receiving element 27B. In this case, the amount of light received by the light receiving element 57B is equal to or more than the threshold value. Meanwhile, when the belt unit 20 is not attached to the frame 30, the light emitted by the light emitting element 57A is reflected, e.g., by an inner wall of the frame 30, and some of the light is scattered in directions different from the direction toward the light receiving element 57B. Therefore, in this case, the amount of light received by the light receiving element 57B is less than the threshold value.

To continue the explanation referring back to FIG. 11, after performing the belt-unit detecting process to detect the belt unit 20 in S10, the controller 100 goes to S20. In S20, the controller 100 determines whether there is a belt unit 20 attached to the frame 30, based on the detection result in S10. When determining in the belt-unit detecting process in S10 that there is a belt unit 20 is attached to the frame 30 (S17), the controller 100 makes an affirmative determination in S20 (S20: Yes). Thereafter, the controller 100 goes to S30.

In S30, the controller 100 performs a waste-toner-box detecting process to detect the waste toner box 27D. The waste-toner-box detecting process includes steps S31 to S43 shown in FIG. 13.

In S31, the controller 100 sets a target value of the cleaning current Ic. Next, in S32, the controller 100 outputs the PWM signal S5. It is noted that, in the first embodiment, the controller 100 outputs the PWM signal S5 with an initial value (20%) as the PWM value (the duty ratio).

The PWM signal S5, after being output, is smoothed by the third PWM signal smoothing circuit 210, then amplified by the amplifier 220, and afterward input to the cleaner voltage applying circuit 230. The cleaner voltage applying circuit 230 generates and outputs a high voltage in response to an input value from the amplifier 220. Thereby, when the belt cleaner 27 is attached to the frame 30, as shown in FIG. 5, the cleaning current Ic flows through the backup roller 27A and the cleaning roller 27B.

After outputting the PWM signal S5 in S32, in S33, the controller 100 waits for a time period of 20 msec until the output is stabilized. Thereafter, in S34, the controller 100 adjusts the PWM value of the PWM signal S5 to rise by a predetermined value (e.g., 2%). Then, the controller 100 waits for a time period of 2 msec.

In S36, the controller 100 detects the cleaning current Ic and determines whether the detected cleaning current Ic is equal to or more than the target value. It is noted that the cleaning current Ic may be detected based on a voltage level of the input port P6.

When determining that the detected cleaning current Ic is equal to or more than the target value (S36: Yes), the controller 100 goes to S41, in which the controller 100 determines that there is a waste toner box 27D attached. Thereafter, the controller 100 goes to S43, in which the controller 100 resets, to zero, the PWM value of the PWM signal S5. Then, the controller 100 terminates the waste-toner-box detecting process.

Meanwhile, when determining that the detected cleaning current Ic is not equal to or more than the target value (the detected cleaning current Ic is less than the target value) (S36: No), the controller 100 goes to S37, in which the controller 100 determines whether the PWM value is equal to or more than an upper limit (e.g., 90%). When determining that the PWM value is not equal to or more than the upper limit (the PWM value is less than the upper limit) (S37: No), the controller 100 goes back to S34, in which the controller 100 increases the PWM value of the PWM signal S5 by the predetermined value (2%).

Meanwhile, when determining that the PWM value is equal to or more than the upper limit (90%) (S37: Yes), the controller 100 goes to S42, in which the controller 100 determines that there is not a waste toner box 27D attached. Afterward, the controller 100 goes to S43, in which the controller 100 resets to zero the PWM value of the PWM signal S5. Then, the controller 100 terminates the waste-toner-box detecting process.

As described above, when the cleaning current Ic is equal to or more than the target value (S36: Yes), it is possible to determine that there is a waste toner box 27D attached to the frame 30 (S41), for the following reasons. When there is a waste toner box 27D attached to the frame 30, as shown in FIG. 5, the roller shaft of the backup roller 27A is electrically connected with the high voltage output terminal T6. Further, the roller shafts of the cleaning roller 27B and the collecting roller 27C are electrically connected with connection terminals T7 and T8, respectively. Accordingly, the controller 100 is allowed to normally implement feedback control, and finally adjust the cleaning current Ic to be equal to or more than the target value by increasing the PWM value of the PWM signal S5 by the predetermined value from the initial value while repeating a loop process R shown in FIG. 13.

Meanwhile, when the PWM value is equal to or more than the upper limit (90%) (S37: Yes), it is possible to determine that there is not a waste toner box 27D attached to the frame 30 (S42), for the following reasons. When there is not a toner box 27D attached to the frame 30, each of the high voltage output terminal T6 and the connection terminals T7 and T8 is put into an open state. Therefore, even though outputting the PWM signal S5, the controller 100 is not allowed to receive the feedback signal Sf corresponding to the cleaning current Ic. In this case, the controller 100 continues to increase the PWM value of the PWM signal S5 by the predetermined value so as to adjust the cleaning current Ic to be equal to or more than the target value, and thus, the PWM value of the PWM signal S5 exceeds the upper limit, without the cleaning current Ic reaching the target value.

To continue the explanation referring back to FIG. 11, after execution of the waste-toner-box detecting process in S30, the controller 100 goes to S50. In S50, the controller 100 determines whether there is a waste toner box 27D attached to the frame 30, based on the detection result in S30. When determining in the waste-toner-box detecting process in S30 that there is a waste toner box 27D attached to the frame 30 (S41), the controller 100 makes an affirmative determination (S50: Yes). Thereafter, the controller 100 goes to S60.

In S60, the controller 100 performs, for each process unit U, a drum-unit detecting process to detect the drum unit U1. The drum-unit detecting process (for each process unit U) is achieved on the same principle as the waste-toner-box detecting process. Specifically, when the PWM value of the PWM signal S1 is increased by a predetermined value from an initial value, and thereby, the grid current Ig is adjusted to be equal to or more than a target value, it is possible to determine that there is a drum unit U1 attached to the frame 30.

Meanwhile, when the PWM value of the PWM signal S1 exceeds an upper limit without the grid current Ig reaching the target value in the case where the PWM value is increased by the predetermined value from the initial value, it is possible to determine that there is not a drum unit U1 attached to the frame 30.

Subsequently, in S70, the controller 100 determines whether every drum unit U1 is attached to the frame 30. When determining in the drum-unit detecting process in S60 that every drum unit U1 is attached to the frame 30, the controller 100 makes an affirmative determination (S70: Yes). Thereafter, the controller 100 goes to S80.

In S80, the controller 100 starts the warm-up operation before printing. The warm-up operation may include the following operations (1) to (5). It is noted that the below-mentioned operation (3) is performed for the following reason. That is to prevent adhesion, to the surface of the photoconductive drum 7, of the toner on the development roller 10, which is likely to adhere to the surface of the photoconductive drum 7 when the photoconductive drum 7 is rotated without being charged.

(1) An operation of agitating toner by supplying electricity to the main motor 51 and rotating the agitator 13 in the toner container 12 of each process unit U.

(2) An operation of supplying electricity to the main motor 51 and rotating the photoconductive drums 7, the development rollers 10, and the transfer rollers 15.

(3) An operation of, concurrently with rotation of the photoconductive drum 7, applying the high voltage to the charger 8 via the high voltage output terminals T and causing the charger 8 to charge the surface of the photoconductive drum 7.

(4) An operation of supplying electricity to the main motor 51 and driving the conveyance belt 21.

(5) An operation of driving the belt cleaner 27 to clean the conveyance belt 21.

In S90, the controller 100 performs, for each process unit U, a toner-unit detecting process to detect the toner unit U2 (e.g., a process of monitoring the voltage of the input port P4 for a predetermined time period in response to rotation of the main motor 51). Afterward, the controller 100 goes to S100, in which the controller 100 determines whether every toner unit U2 is attached to the corresponding drum unit U1.

It is noted that it is possible to determine whether there is a toner unit U2 attached to the frame 30, from the pattern in which the voltage of the input port P4 changes in response to rotation of the main motor 51. Namely, when the voltage pattern of the input port P4 is the pattern 1, it is possible to determine whether there is not a toner unit U2 attached to the frame 30. Meanwhile, when the voltage pattern of the input port P4 is the pattern 2 or the pattern 3, it is possible to determine whether there is a toner unit U2 attached to the frame 30.

When determining in S100 that every toner unit U2 is attached (S100: Yes), the controller 100 goes to S110. In this case, the warm-up operation is continued. Then, after completion of the warm-up operation, the controller 100 terminates the warm-up operation (S120), and ends the execution sequence of the warm-up operation.

In S20, when determining that there is not a belt unit 20 attached to the frame 30 (S20: No), the controller 100 goes to S25. In S25, the controller 100 displays on the display unit 63 an error message that there is not a belt unit 20 attached to the frame 30. In this case, after displaying the error message, the controller 100 skips the steps S30 to S120 and terminates the execution sequence without executing the warm-up operation.

In S50, when determining that there is not a waste toner box 27D attached to the frame 30 (S50: No), the controller 100 goes to S55. In S55, the controller 100 displays on the display unit 63 an error message that there is not a waste toner box 27D attached to the frame 30. In this case, after displaying the error message, the controller 100 skips the steps S60 to S120 and terminates the execution sequence without executing the warm-up operation.

In S70, when determining that every drum unit U1 is not attached to the frame 30 (S70: No), the controller 100 goes to S75. In S75, the controller 100 displays on the display unit 63 an error message that every drum unit U1 is not attached to the frame 30. In this case, after displaying the error message, the controller 100 skips the steps S80 to S120 and terminates the execution sequence without executing the warm-up operation.

In S100, when determining that every toner unit U2 is not attached (S100: No), the controller 100 goes to S105. In S105, the controller 100 interrupts the warm-up operation and displays on the display unit 63 an error message that every toner unit U2 is not attached. In this case, after displaying the error message, the controller 100 terminates the execution sequence.

7. Advantageous Effects

In the printer 1, the waste toner box 27D is disposed in such a position as to close the second communication portion 30B. Therefore, even though there is not any process unit U or a belt unit 20 attached to the frame 30, and the high voltage output terminals T are exposed, it is possible to prevent the user's hand from touching the high voltage output terminals T (electric shock prevention). In other words, as the waste toner box 27D is disposed to close the second communication portion 30B, it is possible to prevent an external access to the high voltage output terminals T through the second communication portion 30B.

Further, in the printer 1, the feed cassette 17 is disposed below the waste toner box 27D, so as to close the second communication portion 30B from outside. Namely, the second communication portion 30B is closed doubly by the waste toner box 27D and the feed cassette 17 so as not to be externally accessed through the second communication portion 30B. Hence, even when one of the waste toner box 27D and the feed cassette 17 is not attached to the frame 30, it is possible to close the second communication portion 30B by the other. Thus, it is possible to ensure a high level of safety.

Further, instead of the waste toner box 27D and the feed cassette 17, a partition may be provided to the frame 30 as an element for closing the second communication portion 30B to ensure the safety. However, the configuration to close the second communication portion 30B with existing components such as the waste toner box 27D and the feed cassette 17 makes it possible to achieve the frame 30 of a smaller size and the printer 1 of a smaller size than the configuration to close the second communication portion 30B with the partition provided to the frame 30.

The warm-up operation includes the operation of causing the charger 8 to charge the surface of the photoconductive drum 7 concurrently with rotation of the photoconductive drum 7, and the operation of driving the belt cleaner 27 to clean the conveyance belt 21. Therefore, during the warm-up operation, the high voltage power supply circuit 110 outputs the high voltage. If the warm-up operation is performed in a situation where the high voltage output terminals T are exposed, the user might insert the user's hand into the inside of the frame 30 through the second communication portion 30B and touch the high voltage output terminals T.

In this respect, the printer 1 of the first embodiment is configured to perform the warm-up operation only when the waste toner box 27D is detected. When the waste toner box 27D is detected, the waste toner box 27D closes the second communication portion 30B, and therefore, it is possible to prevent the user's hand from touching the high voltage output terminals T. Further, when the waste toner box 27D is not detected, the printer 1 does not perform the warm-up operation. In this case, the high voltage power supply circuit 110 is in a halt state where the high voltage output terminals T are not supplied with the high voltage. Thus, even though the user inserts the user's hand into the inside of the frame 30 via the second communication portion 30B and touches the high voltage output terminals T, the user is not electrically shocked. Moreover, since the warm-up operation is not performed, and the main motor 51 is stopped, even though the user touches rotatable bodies such as various rollers, the rotatable bodies are stopped. Thus, it is possible to ensure a high level of safety.

Further, when the upper cover 3D is opened and closed, it is highly likely that one or more of the process units U, the belt unit 20, and the cleaner 27 are detached and attached. In some instances, one or more of the process units U, the belt unit 20, and the cleaner 27 may not be attached to the frame 30. In this case, one or more of the high voltage output terminals T are exposed. Therefore, if the waste toner box 27D is not attached to the frame 30, the user's hand might touch the high voltage output terminals T via the second communication portion 30B.

Figure 11:
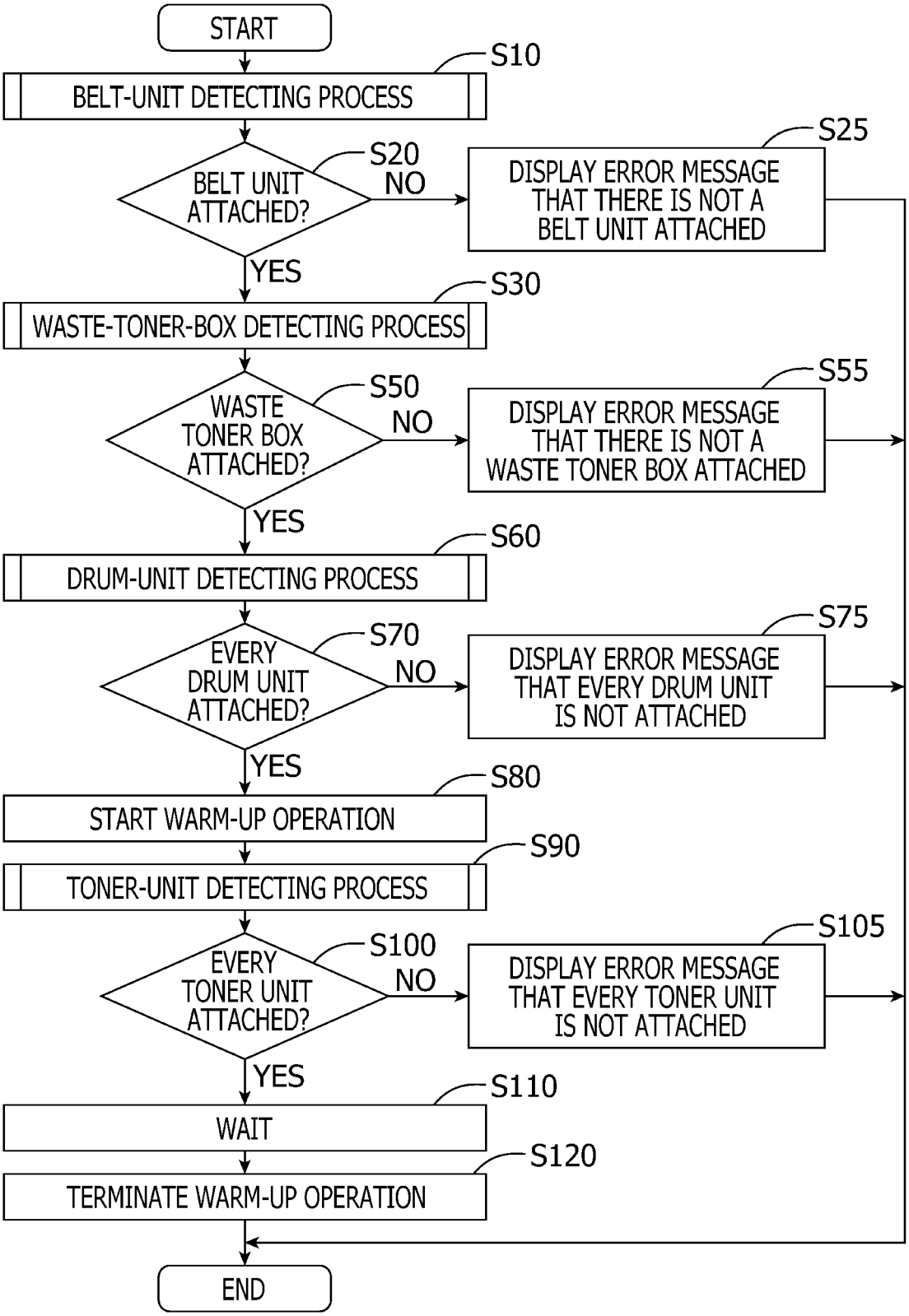
FIG. 11 is a flowchart showing an execution sequence of a warm-up operation in the first embodiment according to one or more aspects of the present invention.

The printer 1 of the first embodiment is configured to launch the execution sequence of the warm-up operation shown in FIG. 11 each time the cover opening-closing switch 55 detects the movement of the upper cover 3D from the open position to the closed position. The execution sequence of the warm-up operation includes the waste-toner-box detecting process to detect the waste toner box 27D (S30). Further, when the waste toner box 27D attached to the frame 30 is not detected, displayed is the error message that there is not a waste toner box 27D attached to the frame 30. Therefore, it is possible to promptly provide the user with a notification that there is not a waste toner box 27D attached to the frame 30, and to ensure a high level of safety.

Further, the printer 1 of the first embodiment is configured to detect whether the belt cleaner 27 is attached to the frame 30, based on the feedback signal Sf for implementing the feedback control of the cleaning current Ic. Therefore, it is possible to achieve a smaller number of components and the printer 1 of a smaller size than a configuration having a sensor specifically for detecting the belt cleaner 27.

Further, in order to detect the belt cleaner 27 using the feedback signal Sf as described above, it is required to apply the high voltage to the backup roller 27A via the high voltage power supply circuit 110. As shown in FIG. 1, the backup roller 27A is disposed inside the space surrounded by the conveyance belt 21, and is configured to be detached integrally with the belt unit 25. Hence, if the belt unit 25 is not attached, the high voltage output terminal T6 for applying the high voltage to the backup roller 27A might be exposed, and the user might be electrically shocked when touching the high voltage output terminal T6.

The printer 1 of the first embodiment is configured to apply the high voltage to the backup roller 27A and detect the belt cleaner 27, in response to detection of the belt unit 25 attached to the frame 30. When the belt unit 25 attached to the frame 30 is detected, the high voltage output terminal T6 is covered with the belt unit 25. Therefore, even though the user inserts the user's hand into the inside of the frame 30 through the second communication portion 30B, the user's hand is not allowed to directly touch the high voltage output terminal T6. Thus, it is possible to ensure a high level of safety.

Second Embodiment

Figure 15:
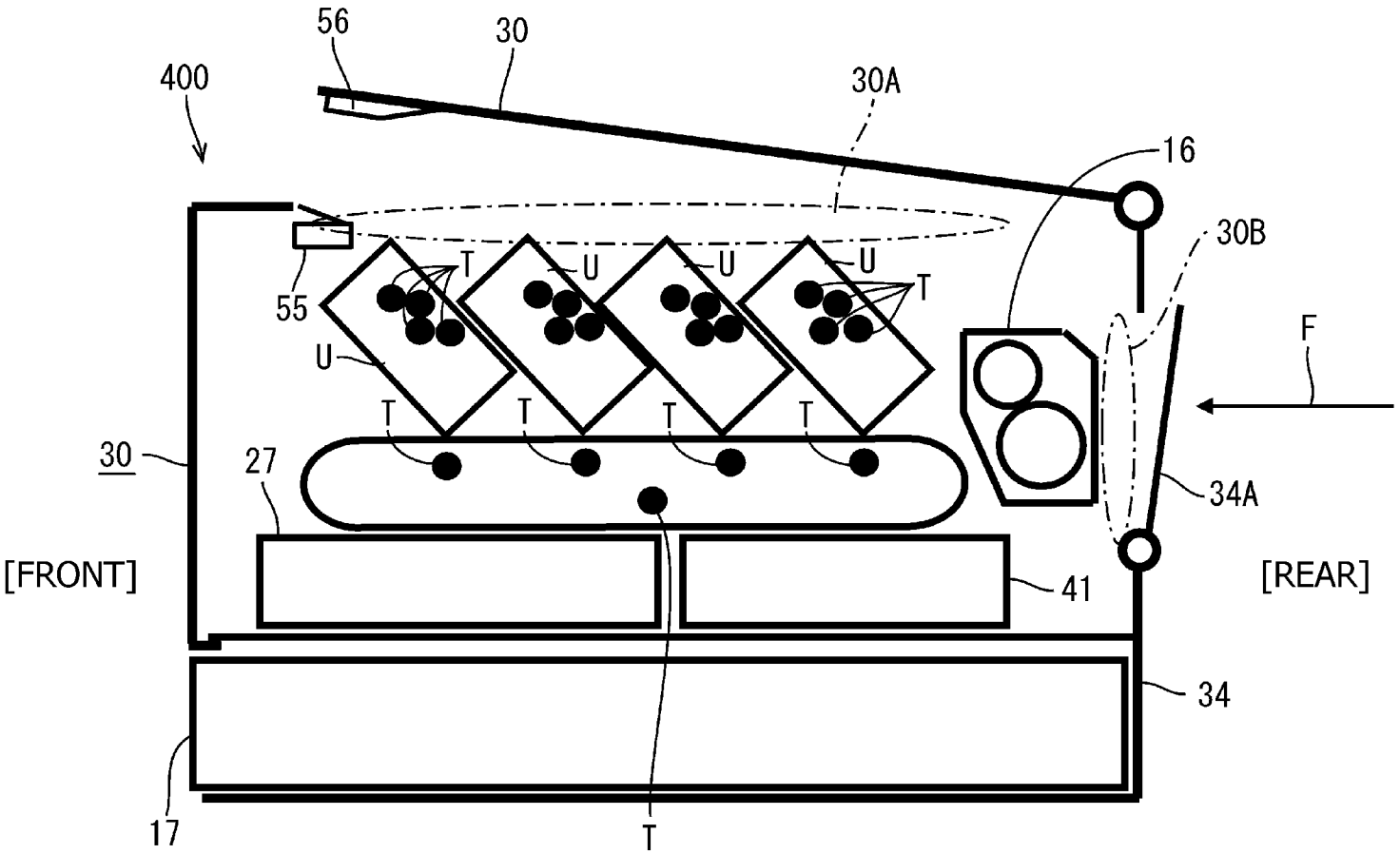
FIG. 15 is a view schematically showing a layout of a second communication portion and other surrounding components of a printer in a second embodiment according to one or more aspects of the present invention.

Subsequently, a second embodiment according to aspects of the present invention will be described with reference to FIG. 15. In the aforementioned first embodiment, the printer 1 includes the first communication portion 30A formed at the upper side of the frame 30 and the second communication portion 30B formed at a lower side of the frame 30. Further, the second communication portion 30B is closed by the waste toner box 27D and the feed cassette 17.

A printer 400 of the second embodiment includes the second communication portion 30B provided at a rear wall 34. Further, as shown in FIG. 15, the printer 400 of the second embodiment includes the fuser unit 16 disposed in a position corresponding to the second communication portion 30B provided at the rear wall 34. Specifically, in the printer 400 of the second embodiment, the fuser unit 16 is disposed in such a position as to close the second communication portion 30B provided at the rear wall 34. Therefore, in the same manner as the first embodiment, even though one or more of the process units U, the belt unit 20, and the cleaner 27 are not attached to the frame 30, and one or more of the high voltage output terminals T are exposed, it is possible to prevent the user's hand from touching the high voltage output terminals T (electric shock prevention).

Further, the printer 400 of the second embodiment includes a rear cover 34A that is provided at the rear wall 34 of the frame 30 and configured to close the second communication portion 30B from outside. Namely, the printer 400 is configured to doubly close the second communication portion 30B with the fuser unit 16 and the rear cover 34A. Therefore, even though the fuser unit 16 is not attached to the frame 30, it is possible to close the second communication portion 30B with the rear cover 34A. Thus, it is possible to ensure a high level of safety.

Preferably, in the same manner as the printer 1 of the first embodiment, the printer 400 of the second embodiment may be configured to perform the warm-up operation in response to detection of the fuser unit 16. Further, a method for detecting the fuser unit 16 attached to the frame 30 may include implementing feedback control to adjust a temperature of the fuser unit 15 to be equal to or more than a target temperature and determining whether the temperature of the fuser unit 15 is equal to or more than the target temperature. Alternatively, a sensor may be provided to detect the fuser unit 15 attached to the frame 30.

Hereinabove, the embodiments according to aspects of the present invention have been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only exemplary embodiments of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are possible. It is noted that, in the following modifications, explanations of the same configurations as exemplified in the aforementioned embodiments will be omitted.

[Modifications]

In the aforementioned first embodiment, the warm-up operation is performed in response to detection of the waste toner box 27D, attached to the frame 30, which is configured to close the second communication portion 30B when attached to the frame 30. However, the printer 1 may include a sensor for detecting the feed cassette 17 attached to the frame 30 and may be configured to forbid execution of the warm-up operation when the feed cassette 17 is not attached to the frame 30.

In the aforementioned first embodiment, the waste toner box 27D is detected using the feedback signal Sf. However, the printer 1 may include a detection sensor for detecting the waste toner box 27D attached to the frame 30. Further, the detection sensor may be any one of various types of sensors such as an optical sensor and an ultrasonic sensor.

In the aforementioned first and second embodiments, the controller 100 includes the (single) CPU 101, the ROM 103, and the RAM 105. However, the controller 100 may include two or more pieces of the CPU 101. Further, the controller 100 may include a combination of the CPU 101 and one or more hardware circuits such as application specific integrated circuits (ASICs). Alternatively, the controller 100 may consist of one or more hardware circuits.

In the aforementioned first embodiment, in order to ensure a high level of safety, the execution of the warm-up operation is forbidden. However, the execution of the warm-up operation may be restricted to such a degree as to ensure a certain level of safety. For example, a method for restricting the execution of the warm-up operation may include decreasing the voltage to be applied to the high voltage loads to such a voltage value as to ensure a certain level of safety, and reducing rotational velocities of the rotatable bodies by decreasing the electric current to be supplied to the main motor 51. Moreover, in the aforementioned first embodiment, the feedback control of the cleaning current Ic is exemplified as a method for controlling the cleaner 27. However, the method for controlling the cleaner 27 may include implementing feedback control of the voltage to be applied to the backup roller 27A or the cleaning roller 27B.

What is claimed is:

1. An image forming apparatus comprising:

an image forming unit configured to perform image formation on a sheet, the image forming unit comprising a process unit;

a frame configured to hold the process unit detachably attached thereto, the frame comprising:

a first communication portion configured to communicate with an outside of the frame through a first opening that is formed at the frame and open in a first direction, the image forming unit being configured to be detached from the frame through the first communication portion and the first opening; and a second communication portion configured to communicate with the outside of the frame through a second opening of the frame that is separate from the first opening and open in a second direction different from the first direction;

a voltage output terminal provided to the frame and configured to apply therethrough a voltage to one or more voltage loads including the image forming unit;

a material holder configured to hold material for the image formation by the image forming unit and detachably attach to a predetermined portion of the frame so as to close the second communication portion;

a controller configured to:

execute a material-holder detecting process for determining whether the material holder is attached to the predetermined portion of the frame; and execute a warm-up operation in response to determining that the material holder is attached to the predetermined portion and not execute the warm-up operation in response to determining that the material holder is not attached to the predetermined portion;

a cover attached to the frame to be movable between:

an open position where the image forming unit is allowed to be attached to and detached from the frame through the first communication portion; and a closed position to close the first communication portion; and a cover position detector configured to detect whether the cover is in the open position or the closed position, wherein the material holder is configured to be detachably attached to the frame through the first communication portion, and wherein the controller is further configured to perform the material-holder detecting process when the cover position detector detects a positional change of the cover from the open position to the closed position.

2. The image forming apparatus according to claim 1, wherein the controller is further configured to:

apply the voltage to the one or more voltage loads via the voltage output terminal in the warm up operation; and not apply the voltage to the one or more voltage loads in response to determining that the material holder is not attached to the predetermined portion.

3. The image forming apparatus according to claim 1, further comprising a motor configured to drive the image forming unit, wherein the controller is further configured to:

supply electricity to the motor in the warm up operation; and not supply electricity to the motor in response to determining that the material holder is not attached to the predetermined portion.

4. The image forming apparatus according to claim 1, further comprising a second material holder detachably attached to a second predetermined portion of the frame and configured to hold second material for the image formation and to close the second communication portion from the outside.

5. The image forming apparatus according to claim 4, wherein the second material holder comprises a sheet holder configured to hold the sheet to be fed to the image forming unit.

6. The image forming apparatus according to claim 1, wherein the material holder comprises a developer holder configured to hold development agent for the image formation.

7. The image forming apparatus according to claim 6, further comprising:

a conveyance belt configured to convey the sheet;

a belt cleaner configured to clean the conveyance belt; and a developer storage unit configured to store development agent removed from the conveyance belt by the belt cleaner, wherein the developer holder comprises the developer storage unit.

8. The image forming apparatus according to claim 7, further comprising:

a voltage applying unit configured to apply a voltage to the belt cleaner via the voltage output terminal so as to electrically clean the conveyance belt; and a signal detector configured to detect a signal output from the voltage output terminal in response to the voltage applying unit applying the voltage to the belt cleaner via the voltage output terminal, wherein the developer holder comprises the belt cleaner, and wherein the controller is further configured to:

detect whether the developer holder comprising the belt cleaner is attached to the frame, based on the signal detected by the signal detector; and control the voltage to be applied to the belt cleaner, based on a detection result of the signal detector, while the belt cleaner is cleaning the conveyance belt.

9. The image forming apparatus according to claim 8, further comprising a belt detector configured to detect whether the conveyance belt is attached to the frame, wherein the belt cleaner comprises:

a cleaning roller configured to contact an outer circumferential surface of the conveyance belt; and a backup roller disposed to face the cleaning roller across the conveyance belt and configured to contact an inner circumferential surface of the conveyance belt, wherein the controller is further configured to apply a voltage to the backup roller via the voltage output terminal so as to detect whether the developer holder is attached to the frame, when the belt detector detects the conveyance belt attached to the frame.

10. An image forming apparatus comprising:

an image forming unit configured to perform image formation on a sheet, the image forming unit comprising a process unit;

a frame configured to hold the process unit detachably attached thereto, the frame comprising:

a first communication portion configured to communicate with an outside of the frame through a first opening that is formed at the frame and open in a first direction, the image forming unit being configured to be detached from the frame through the first communication portion; and a second communication portion configured to communicate with the outside of the frame through a second opening of the frame that is separate from the first opening and open in a second direction different from the first direction;

a voltage output terminal provided to the frame and configured to apply therethrough a voltage to one or more voltage loads including the image forming unit;

a material holder configured to hold material for the image formation by the image forming unit and detachably attach to a predetermined portion of the frame so as to close the second communication portion and prevent an external access to the voltage output terminal through the second communication portion, the material holder comprising at least one of:

a developer holder configured to hold development agent for the image formation;

a sheet holder configured to hold the sheet to be fed to the image forming unit; and an image fixing unit configured to hold the sheet being conveyed therethrough and fix an image formed on the sheet by the image forming unit; and a cover attached to the frame to be movable between:

a closed position where the cover covers the first communication portion; and an open position where the cover does not cover the first communication portion;

a cover detector configured to detect whether the cover is in the open position or the closed position;

a material holder detector configured to detect whether the material holder is attached to the predetermined portion; and a controller configured to:

in response to detecting a positional change of the cover from the open position to the closed position according to a detecting result of the cover position detector, determine whether the material holder is attached to the predetermined portion of the frame according to a detecting result of the material holder detector; and execute a warm-up operation in response to determining that the material holder is attached to the predetermined portion and not execute the warm-up operation in response to determining that the material holder is not attached to the predetermined portion.

11. The image forming apparatus according to claim 10, wherein the material holder comprises the developer holder.

12. The image forming apparatus according to claim 11, wherein the material holder further comprises the sheet holder detachably attached to a portion of the frame and configured to close the second communication portion from the outside.

13. The image forming apparatus according to claim 10, wherein the material holder comprises the image fixing unit.

* * * * *